US005302503A

United States Patent [19]

Saito et al.

[11] Patent Number: 5,302,503

[45] Date of Patent: Apr. 12, 1994

[54] SILVER HALIDE PHOTOGRAPHIC LIGHT-SENSITIVE MATERIAL

[75] Inventors: Naoki Saito; Keiji Mihayashi; Takayoshi Kamio, all of Minami-Ashigara, Japan

[73] Assignee: Fuji Photo Film Co., Ltd., Kanagawa, Japan

[21] Appl. No.: 836,505

[22] Filed: Feb. 18, 1992

[30] Foreign Application Priority Data

Feb. 18, 1991 [JP] Japan ..... 3-044091

[51] Int. Cl.[5] ..... G03C 7/34; G03C 7/36; G03C 7/38; G03C 7/384

[52] U.S. Cl. ..... 430/552; 430/553; 430/554; 430/555; 430/556; 430/557; 430/558

[58] Field of Search ..... 430/556, 557, 388, 389, 430/554, 555, 386, 387, 558, 552, 553, 384, 385, 543

[56] References Cited

U.S. PATENT DOCUMENTS 4,617,256 10/1986 Kunitz et al. ..... 430/557

FOREIGN PATENT DOCUMENTS 0073636 3/1983 European Pat. Off. .
3441525 5/1986 Fed. Rep. of Germany .
37-61251 12/1962 Japan .
46645 11/1984 Japan .
128249 6/1986 Japan .
909318 10/1962 United Kingdom .

*Primary Examiner*—Lee C. Wright
*Attorney, Agent, or Firm*—Sughrue, Mion, Zinn, Macpeak & Seas

[57] ABSTRACT

A silver halide color photographic light-sensitive material includes a support and at least one hydrophilic colloid layer formed on the support. The hydrophilic layer contains a coupler compound which is represented by formula (I) below and has a high dye formation rate and a high color forming density. This silver halide color photographic light-sensitive material can achieve an improved sharpness and a high sensitivity:

$$A-(SO_2NHCONR^1R^2)_n \qquad \text{Formula (I)}$$

(wherein A represents a coupler moiety, each of $R^1$ and $R^2$ independently represents a hydrogen atom, an alkyl group, an alkenyl group, an alkynyl group, an aryl group, or a heterocyclic group, and n represents an integer of 1 or more, if n being an integer of 2 or more, respective $R^1$'s and $R^2$'s being able to be the same or different, and A and $R^1$, A and $R^2$, or $R^1$ and $R^2$ being able to combine to form a ring.)

12 Claims, No Drawings

SILVER HALIDE PHOTOGRAPHIC LIGHT-SENSITIVE MATERIAL

BACKGROUND OF THE INVENTION

1. Field of the Invention

The present invention relates to a silver halide color photographic light-sensitive material containing a novel coupler and, more particularly, to a color photographic light-sensitive material which can achieve an improved sharpness and a high sensitivity when image formation is performed in the presence of a novel coupler having a high reactivity.

2. Description of the Related Art

In a color photographic light-sensitive material, when color development is performed after the material is exposed, an oxidized aromatic primary amine developing agent and a coupler react with each other to form an image. This method adopts a color reproduction technique according to subtractive color processes. In order to reproduce blue, green, and red, color images of their complementary colors, i.e., yellow, magenta, and cyan are formed.

Each coupler is required not only to form a dye but also to have various characteristics such as good spectral absorption characteristics of the formed dye, a high dye formation rate, a high color forming density, and a high fastness of the formed dye against light, heat, and humidity. In particular, since a higher sensitivity and a higher image quality have been required for light-sensitive materials in recent years, a strong demand has arisen for development of a coupler having a high dye formation rate and a high color forming density. In addition, in designing a DIR coupler (a coupler which releases a development inhibitor when reacting with an oxidized form of an aromatic primary amine developing agent and is used to improve the sharpness and the color reproducibility of an image), the above properties are very important factors.

One effective means of increasing the dye formation rate is a method of introducing an acid dissociation group or a high polar group to a coupler molecule. Examples are a method described in JP-A-58-42045 ("JP-A" means Published Unexamined Japanese Patent Application) in which a p-hydroxybenzenesulfonyl group or a p-hydroxybenzenesulfinyl group is introduced, and methods described in British Patent 909,318, JP-B-62-61251 ("JP-B" means Published Examined Japanese Patent Application), and JP-A-61-121054 in which an N-acylsulfamoyl group is introduced. However, these methods are still unsatisfactory and required to be further improved.

SUMMARY OF THE INVENTION

It is an object of the present invention to provide a color photographic light-sensitive material which can achieve an improved sharpness and a high sensitivity when image formation is performed in the presence of a coupler having a high dye formation rate and a high color forming density.

The above object of the present invention is achieved by a silver halide color photographic light-sensitive material, containing a coupler compound represented by formula (I) below in at least one hydrophilic colloid layer formed on a support:

$$A-(SO_2NHCONR^1R^2)_n \qquad \text{Formula (I)}$$

(wherein A represents a coupler moiety, each of $R^1$ and $R^2$ independently represents a hydrogen atom, an alkyl group, an alkenyl group, an alkynyl group, an aryl group, or a heterocyclic group, and n represents an integer of 1 or more, if n being an integer of 2 or more, respective $R^1$'s and $R^2$'s being able to be the same or different, and A and $R^1$, A and $R^2$, or $R^1$ and $R^2$ being able to combine to form a ring.)

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

A compound represented by formula (I) used in the present invention will be described in detail below.

$$A-(SO_2NHCONR^1R^2)_n \qquad \text{(I)}$$

In formula (I), A represents a coupler moiety which is introduced from, for example, the following couplers: an image forming coupler., DIR couplers (e.g., couplers described in U.S. Pat. Nos. 3,227,554, 4,146,396, 4,248,962, 4,409,323, 4,421,845, 4,477,563, and 3,148,062); weak diffusing dye forming couplers (e.g., couplers described in U.S. Pat. Nos. 4,522,915 and 4,420,556); a developing accelerator or fogging agent releasing coupler (e.g., a coupler described in U.S. Pat. No. 4,390,618); colored couplers (e.g., couplers described in U.S. Pat. Nos. 4,004,929, 4,138,258, and 4,070,191); a competing coupler (e.g., a coupler described in U.S. Pat. No. 4,130,427); poly-equivalent couplers (e.g., couplers described in U.S. Pat. Nos. 4,283,472, 4,338,393, and 4,310,618); a DIR redox compound releasing coupler (e.g., a coupler described in JP-A-60-185950); a coupler releasing a dye which turns to a colored form after being split-off (e.g., a coupler described in EP 173,302); and various polymer couplers (e.g., couplers described in U.S. Pat. Nos. 3,767,412, 3,623,871, 4,367,282, and 4,474,870).

A dye formed from the coupler may be any of yellow, magenta, and cyan. Examples of the yellow coupler are an acylacetoamide type coupler, a malondiamide type coupler, a malondiester type coupler, a malonesteramide type coupler, a dibenzoylmethane type coupler, and a 1-heterocyclic acetoamide type coupler. Examples of the magenta coupler are a 5-pyrazolone type coupler, a pyrazoloimidazole type coupler, a pyrazolotriazole type coupler, a pyrazolobenzimidazole type coupler, and a cyanoacetophenone type coupler. Examples of the cyan coupler are a phenol type coupler, a naphthol type coupler, and an imidazole type coupler. Each coupler may be either a four- or two-equivalent coupler and may be a coupler which does not essentially form a dye. Examples of such a coupler are those described in, e.g., U.S. Pat. Nos. 3,958,993, 3,961,959, 4,315,070, 4,183,752, and 4,171,223.

A preferable coupler usable in the present invention is represented by formula (Cp-1), (Cp-2), (Cp-3), (Cp-4), (Cp-5), (Cp-6), or (Cp-7) below.

Formula (Cp-1)

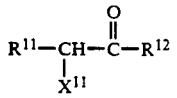

Formula (Cp-2)

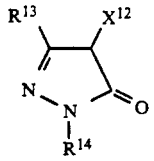

Formula (Cp-3)

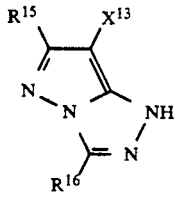

Formula (Cp-4)

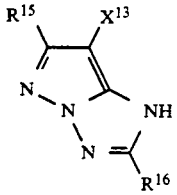

Formula (Cp-5)

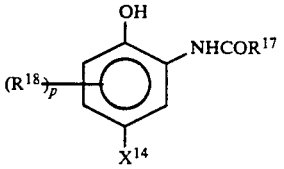

Formula (Cp-6)

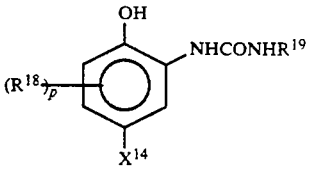

Formula (Cp-7)

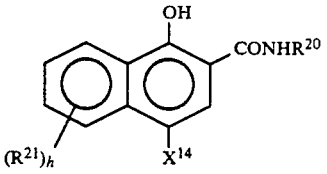

$R^{11}$ to $R^{21}$, $X^{11}$ to $X^{14}$, p, and h will be described below. In the above formulas, if any of $R^{11}$ to $R^{21}$ and $X^{11}$ to $X^{14}$ contains a nondiffusing group, this nondiffusing group is so selected as to have a total number of carbon atoms of 8 to 40, and preferably 12 to 32. In other cases, the total number of carbon atoms is preferably 15 or less. In the case of a bis, telomer, or polymer type coupler, any of the substituents enumerated above represents a divalent group and combines, e.g., a repeating unit. In this case, the number of carbon atoms described above may fall outside the above-defined range.

In the following description, $R^{31}$ represents an alkyl group, an alkenyl group, an akynyl group, an aryl group, or a heterocyclic group, $R^{32}$ represents an aryl group or a heterocyclic group, and each of $R^{33}$, $R^{34}$, and $R^{35}$ independently represents a hydrogen atom, an alkyl group, an alkenyl group, an alkynyl group, an aryl group, or a heterocyclic group.

$R^{11}$ represents $R^{31}CO$—, $R^{32}$, or $R^{33}R^{34}NCO$—, and $R^{12}$ represents $R^{33}$, $R^{33}O$—, or $R^{33}R^{34}N$—. $R^{13}$ represents $R^{31}$, $R^{31}CONR^{33}$—, $R^{31}R^{33}N$—, $R^{31}SO_2NR^{33}$—, $R^{31}S$—, $R^{33}O$—, $R^{33}R^{35}NCONR^{34}$—, $R^{31}O_2C$—, $R^{33}R^{34}NCO$—, or N≡C—.

$R^{14}$ have the same meaning as $R^{31}$. Each of $R^{15}$ and $R^{16}$ independently represents $R^{33}$, $R^{31}S$—, $R^{33}O$, $R^{31}CONR^{33}$—, $R^{31}R^{33}N$—, $R^{31}OCONR^{33}$—, $R^{33}R^{34}NCONR^{35}$—, or $R^{31}SO_2NR^{33}$—.

$R^{17}$ have the same meaning as $R^{31}$. $R^{18}$ represents $R^{31}$, $R^{31}CONR^{33}$—, $R^{31}OCONR^{33}$—, $R^{31}SO_2NR^{33}$—, $R^{33}R^{34}NCONR^{35}$—, $R^{33}R^{34}NSO_2NR^{35}$—, $R^{31}S$—, $R^{33}O$—, a halogen atom, or $R^{31}R^{33}N$—.

p represents 0, 1, 2, or 3. If p represents the plural number, the respective $R^{18}$'s may be the same or different or may combine as divalent groups to form a cyclic structure. Examples of the divalent group for forming the cyclic structure are formulas (Cy-1), (Cy-2), and (Cy-3) below.

(Cy-1)

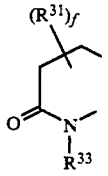

(Cy-2)

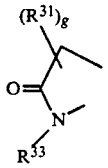

(Cy-3)

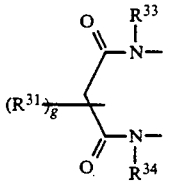

wherein f represents an integer from 0 to 4, and g represents an integer from 0 to 2.

$R^{19}$ and $R^{20}$ have the same meaning as $R^{31}$. $R^{21}$ represents $R^{31}$, $R^{31}CONH$—, $R^{31}OCONH$—, $R^{31}SO_2NH$—, $R^{33}R^{34}NCONR^{35}$—, $R^{33}R^{34}NSO_2NR^{35}$—, $R^{31}S$—, $R^{33}O$—, a halogen atom, or $R^{31}R^{33}N$—. h represents an integer from 0 to 4. If a plurality of $R^{31}$'s are present, they may be the same or different.

The alkyl group has 1 to 30, and most preferably 1 to 22 carbon atoms and may be straight-chain or branched, or chain-like or cyclic. Examples of the alkyl group are methyl, ethyl, propyl, isopropyl, isoamyl, 2-ethylhexyl, dodecyl, and cyclohexyl. These groups may be further substituted.

The alkenyl group has 1 to 30, and most preferably 1 to 22 carbon atoms and may be chain-like or cyclic. Examples of the alkenyl group are vinyl, allyl, 1-methylvinyl, 1-cyclopentenyl, and 1-cyclohexenyl. These groups may be further substituted.

The alkynyl group has 1 to 30, and most preferably 1 to 22 carbon atoms. Examples of the alkynyl group are ethynyl, 1 propynyl, and 3,3-dimethyl-1-butynyl. These groups may be further substituted.

The aryl group has 6 to 20, and most preferably 6 to 10 carbon atoms. Examples of the aryl group are phenyl, naphthyl, and anthracenyl. These groups may be further substituted.

The heterocyclic group is preferably a 5- to 7-membered ring, the hetero atom is preferably a nitrogen atom, an oxygen atom, or a sulfur atom, and the number of carbon atoms is preferably 1 to 10. Examples of the heterocyclic group are 2-furyl, 2-thienyl, 2-pyridyl, 2-imidazolyl, 2-(1,3-oxazolyl), 5-tetrazolyl, 1-piperidinyl, 1 indolinyl, 2-indolinyl, 1,3,4-thiadiazole-2-yl, benzoxazole 2 yl, benzothiazole-2-yl, benzoimidazole-2-yl, 1,2,4-triazole-5-yl, 3-pyrazolyl, 1-morpholyl, 2-morpholyl, 2-quinolyl, and 2-quinazolyl. These groups may be further substituted.

When the alkyl group, the alkenyl group, the alkynyl group, the aryl group, and the heterocyclic group have substituents, representative substituents are an alkyl group (having the same meaning as the alkyl group represented by $R^{33}$ to $R^{35}$), an alkenyl group (having the same meaning as the alkenyl group represented by $R^{33}$ to $R^{35}$), an alkynyl group (having the same meaning as the alkynyl group represented by $R^{33}$ to $R^{35}$), an aryl group (having the same meaning as the aryl group represented by $R^{31}$ to $R^{35}$), a heterocyclic group (having the same meaning as the heterocyclic group represented by $R^{31}$ to $R^{35}$), a halogen atom (e.g., a fluorine, chlorine, or bromine atom), a cyano group, a nitro group, $—NR^{33}R^{34}$, $—OR^{33}$, $—OCOR^{33}$, $—OCONR^{33}R^{34}$, $—OSiR^{33}R^{34}R^{35}$, $—OSO_2R^{33}$, $—NR^{33}COR^{34}$, $—NR^{33}CONR^{34}R^{35}$, $—N(COR^{33})_2$, $—NR^{33}SO_2NR^{34}R^{35}$, $—NR^{33}CO_2R^{34}$, $—NR^{33}SO_2R^{34}$, $—CONR^{33}R^{34}$, $—COR^{33}$, $—CO_2R^{33}$, $—SO_2NR^{33}R^{34}$, $—SO_2R^{33}$, $—SOR^{33}$, $—SR^{33}$, $—SiR^{33}R^{34}R^{35}$, $—SO_2NHCOR^{33}$, $—SO_2NHCO_2R^{33}$, $—CONHCOR^{33}$, $—CONHSO_2R^{33}$, $—CONHSO_2NR^{33}R^{34}$, and $—P(O)(OR^{33})_2$.

Preferable ranges of $R^{11}$ to $R^{21}$, p, and h will be described below.

$R^{11}$ is preferably $R^{31}CO—$, a heterocyclic group, or $R^{33}R^{34}NCO—$. In this case, $R^{31}$ is preferably an alkyl group or an aryl group, each of $R^{33}$ and $R^{34}$ is independently, preferably a hydrogen atom, an alkyl group, or an aryl group, and the heterocyclic group is preferably a nitrogen-containing unsaturated heterocyclic ring.

$R^{12}$ is preferably $R^{33}R^{34}N—$. In this case, each of $R^{33}$ and $R^{34}$ is independently, preferably a hydrogen atom, an alkyl group or an aryl group.

$R^{13}$ is preferably $R^{31}CONH—$ or $R^{31}R^{33}N—$. In this case, $R^{31}$ is preferably an alkyl group or an aryl group, and $R^{33}$ is preferably a hydrogen atom, an alkyl group, or an aryl group. $R^{14}$ is preferably an aryl group.

Each of $R^{15}$ and $R^{16}$ is preferably an alkyl group, an aryl group, $R^{33}O—$, or $R^{31}S—$.

$R^{17}$ is preferably an alkyl group or an aryl group.

In formula (Cp-5), $R^{18}$ is preferably a chlorine atom, an alkyl group, or $R^{31}CONH—$, and p is preferably 1 or 2.

$R^{19}$ is preferably an aryl group.

In formula (Cp-6), $R^{18}$ is preferably $R^{31}CONH—$, and p is preferably 1.

$R^{20}$ is preferably an alkyl group or an aryl group.

In formula (Cp-7), h is preferably 0 or 1, and $R^{21}$ is preferably $R^{31}OCONH—$, $R^{31}CONH—$, or $R^{31}SO_2NH—$. The substitution position of $R^{21}$ is preferably the 5 position of a naphthol ring.

Representative examples of $R^{11}$ to $R^{21}$ will be described below.

When $R^{11}$ is represented by $R^{31}CO—$, examples of $R^{31}$ are t-butyl, 4-methoxyphenyl, phenyl, 3-[2-(2,4-di-t-amylphenoxy)butaneamide]phenyl, 4-octadecyloxyphenyl, and methyl.

When $R^{11}$ have the same meaning as $R^{32}$, examples of $R^{11}$ are phenyl, 1-methyl-3-nitro-1,2,4-triazole-5-yl, 3-[2-(2,4-di-t-amylphenoxy)butaneamide]-1-methyl-1,2,4-triazole-5-yl, 4,5-dicyano-1-methylimidazole-2-yl, 1-methyl-4-nitroimidazole-2-yl, 1-benzyltetrazole-5-yl, 1,3-oxazole-2-yl, 1,3-thiazole-2-yl, benzoxazole-2-yl, benzothiazole-2-yl, benzoimidazole-2-yl, 2-pyridyl, 4-pyridyl, 3-nitropyridine-2-yl, 5-nitropyridine-2-yl, 2-pyrimidyl, 3-pyrimidyl, 2-chloropyrimidine-4-yl, 2-triazyl, and 2-benzyl-4-nitropyrazole-5-yl.

When $R^{11}$ represents $R^{33}R^{34}NCO—$, examples of each of $R^{33}$ and $R^{34}$ are independently a hydrogen atom, methyl, phenyl, 2,4-dichlorophenyl, 4-cyanophenyl, 3,4-dicyanophenyl, 3-methylphenyl, 2-cyanoethyl, benzyl, 2-pyridyl, 4-pyridyl, 2-pyrimidyl, 2-chloro-5dodecyloxycarbonylphenyl, 2-chloro-5-hexadecylsulfonamidephenyl, 2-chloro-5-tetradecaneamidephenyl, 2-chloro-5-{4-(2,4-di-t-amylphenoxy)butaneamide}phenyl, 2-chloro-5-{2-(2,4-di-t-amylphenoxy)butaneamide}phenyl, 2-methoxyphenyl, 2-methoxy-5tetradecyloxycarbonylphenyl, 2-chloro-5-(1-ethoxycarbonylethoxycarbonyl)phenyl, 2-pyridyl, 2-chloro-5-octyloxycarbonylphenyl, 2,4-dichlorophenyl, 2-chloro-5-(1-dodecyloxycarbonylethoxycarbonyl)phenyl, 2-chlorophenyl, and 2-ethoxyphenyl.

When $R^{12}$ have the same meaning as $R^{33}$ or is represented by $—OR^{33}$, examples of $R^{33}$ are methyl, ethyl, 2-ethylhexyl, 2-hexyldecyl, dodecyloxyethyl, phenyl, o-chlorophenyl, 4-[2-(2,4-di-t-amylphenoxy)-butaneamide]phenyl, 3-pyridyl, and 1-methylimidazole-2-yl.

When $R^{12}$ is represented by $—NR^{33}R^{34}$, examples of $R^{33}$ and $R^{34}$ are the same as those enumerated above for $R^{33}$ and $R^{34}$ in the explanation of $R^{11}$.

Examples of R13 are 3-{2-(2,4-di-t-amylphenoxy)-butaneamide}benzamide, 3-{4-(2,4-di-t-amylphenoxy)-butaneamide}benzamide, a 2-chloro-5-tetradecaneamideaniline group, 5-(2,4-di-t-amylphenoxyacetoamide)benzamide, 2-chloro-5-dodecenylsuccinimideanilino, 2-chloro-5-{2-(3-t-butyl-4-hydroxyphenoxy)tetradecaneamide}anilino, 2,2-dimethylpropaneamide, 2-(3-pentadecylphenoxy)butaneamide, pyrrolidino, and N,N-dibutylamino. Examples of $R^{14}$ are 2,4,6-trichlorophenyl, 2-chlorophenyl, 2,5-dichlorophenyl, 2,3-dichorophenyl, 2,6-dichloro-4-methoxyphenyl, 4-{2-(2,4-di-t-amylphenoxy)-butaneamide}phenyl, and 2,6-dichloro-4-methanesulfonylphenyl. Examples of $R^{15}$ are methyl, ethyl, isopropyl, methoxy, ethoxy, methylthio, ethylthio, 3-phenylureido, and 3-(2,4-di-t-amylphenoxy)propyl. Examples of $R^{16}$ are 3-(2,4-di-t-amylphenoxy)propyl, 3-[4-{2-[4-(4-hydroxyphenylsulfonyl)phenoxy]tetradecane amidephenyl]propyl, methoxy, methylthio, ethylthio, methyl, 1-methyl-2-(2-octyloxy-5-[2-octyloxy-5-(1,1,3,3-tetramethylbutyl)phenylsulfonamide]phenylsulfonamide]ethyl, 3-{4-(4-dodecyloxyphenylsulfonamide)phenyl}propyl, 1,1-dimethyl-2-(2-octyloxy-5-(1,1,3,3-tetramethylbutyl) phenylsulfonamide]ethyl, and dodecylthio. Examples of $R^{17}$ are 2-chlorophenyl, pentafluorophenyl, heptafluoropropyl, 1-(2,4-di-t-amylphenoxy)propyl, 3-(2,4-di-t-amylphenoxy)propyl, 2,4-di-t-amylmethyl, and furyl. Examples of $R^{18}$ are a chlorine atom, methyl, ethyl, propyl, butyl, isopropyl, 2-(2,4-di-t-amylphenoxy)butaneamide, 2-(2,4-di-t-amylphenoxy)hexaneamide, 2-(2,4-di t-octylphenoxy)octaneamide, 2-(2-chlorophenoxy)tetradecaneamide, 2-{4-(hydroxyphenylsulfonyl)phenoxy}tetradecaneamide, and 2-{2-(2,4-di-t-amylphenoxyacetoamide)phenoxy}butaneamide. Examples of $R^{19}$ are 4-cyanophenyl, 2-cyanophenyl, 4-butylsulfonylphenyl, 4-propylsulfonylphenyl, 4-chloro-3-cyanophenyl, 4-ethoxycarbonylphenyl, and 3,4-dichlorophenyl. Examples of $R^{20}$ are dodecyl, hexadecyl, cyclohexyl, 3-(2,4-di-t-amylphenoxy)propyl, 4-(2,4-di-t-amylphenoxy)butyl, 3-dodecyloxypropyl, t-butyl, 2-methoxy-5-dodecyloxycarbonylphenyl, and 1-naphthyl. Examples of $R^{21}$ are isobutyloxycarbonylamino, ethoxycarbonylamino, phenylsulfonylamino, methanesulfonamide, benzamide, trifluoroacetoamide, 3-phenylureido, butoxycarbonylamide, and acetoamide.

$X^{11}$ to $X^{14}$ will be described below. Each of $X^{11}$ to $X^{14}$ independently represents a coupling split-off group or a hydrogen atom. Preferable examples of $X^{11}$ to $X^{14}$ will be described below.

Preferable examples of $X^{11}$ are $R^{32}O$—, an imide group (e.g., 2,4-dioxo-1,3-imidazolidine-3-yl, 2,4-dioxo-1,3-oxazolidine-3-yl, 3,5-dioxo-1,2,4-triazolidine-4-yl, succinimide, futhalimide, and 2,4-dioxo-1,3-imidazolidine-1-yl) which combines with a coupling position by a nitrogen atom, an unsaturated nitrogen-containing heterocyclic group (e.g., 1-imidazolyl, 1-pyrazolyl, 1,2,4-triazole-2 (or 4)-yl, benzotriazole-1-yl, and 3-pyrazoline-5-one-1-yl) which combines with a coupling position by a nitrogen atom, and $R^{31}S$—.

Preferable examples of $X^{12}$ are $R^{31}S$—, an unsaturated nitrogen-containing heterocyclic group (e.g., 1-pyrazolyl, 1-imidazolyl, 1,2,4-triazole-2 or 4)-yl, benzotriazole-1-yl, benzoimidazolyl, and benzoindazolyl), and $R^{32}O$—.

Preferable examples of $X^{13}$ are a halogen atom, $R^{31}S$—, $R^{31}O$—, $R^{31}CO_2$—, and an unsaturated nitrogen-containing heterocyclic group (e.g., 1-pyrazolyl, 1-imidazolyl, and benzotriazole-1-yl) which combines with a coupling position by a nitrogen atom.

Preferable examples of $X^{14}$ are a halogen atom, $R^{31}O$—, and $R^{31}S$—.

When $X^{11}$, $X^{12}$, and $X^{13}$ represent the heterocyclic groups, they may have substituents at substitutable positions. Representative examples of the substituent are those enumerated above for $R^{31}$ when $R^{31}$ represents a heterocyclic group.

Representative examples of $X^{11}$ to $X^{14}$ will be described below.

Examples of $X^{11}$ are 1-benzyl-5-ethoxy-2,4-dioxo-1,3-imidazolidine-3-yl, 1-methyl-5-hexyloxy-2,4-dioxo-1,3-imidazolidine-3-yl, 1-phenyl-5-benzyl-2,4-dioxo-1,3-5-triazolidine-3-yl, 5,5-dimethyl-2,4-dioxo-1,3-oxazolidine-3-yl, 1-pyrazolyl, 4,5-bis(methoxycarbonyl-)imidazole-1-yl, 2-phenylcarbamoyl-1,3-imidazolyl-1-yl, 6-methylxanthine-1-yl, 4-(4-hydroxyphenylsulfonyl)phenoxy, 2-chloro-4-(2-chloro-4hydroxyphenylsulfonyl)phenoxy, 5-phenoxycarbonyl-1-benzotriazolyl, 4-carboxyphenoxy, and 4-(4-benzyloxyphenylsulfonyl)-phenoxy.

Examples of $X^{12}$ are a hydrogen atom, 1-pyrazolyl, 3-chloro-5-methyl-1,2,4-triazole-2-yl, 5-phenoxycarbonyl-1-benzotriazolyl, 2-butoxy-5-(1,1,3,3-tetramethylbutyl)phenylthio, 4-chloro-1-pyrazolyl, 4-{3-(2-decyl-4-methylphenoxyacetoxy)propyl}pyrazole-1-yl, dodecyloxycarbonylmethylthio, 1-phenyltetrazolyl-5-thio, and 4-dodecylsulfamoylphenoxy.

Examples of $X^{13}$ are a chlorine atom, a hydrogen atom, 4-methylphenoxy, 4-cyanophenoxy, 2-butoxy-5-(1,1,3,3-tetramethylbutyl)phenylthio, 1-pyrazolyl, and 2-(2-phenoxyethoxy)-5-(1,1,3,3-tetramethylbutyl)phenylthio.

Examples of $X^{14}$ are a chlorine atom, a hydrogen atom, 4-methoxyphenoxy, 4-(1,1,3,3-tetramethylbutyl)-phenoxy, 2-carboxyethylthio, 2-(2-carboxyethylthio)ethoxy, 1-phenyltetrazolyl-5-thio, 1-ethyltetrazolyl-5-thio, 3-carboxypropoxy, 5-phenoxycarbonylbenzotriazole-1-methoxy, 2,3-dihydroxy-4-(1-phenyltetrazolyl-5-thio)-5-propylcarbamoylphenoxy, 2-(1-carboxytridecylthio)ethoxy, 2-(2-methoxyethylcarbamoyl)ethoxy, 2-(2-methoxyethylcarbamoyl)ethoxy, and 2-{4-(8-acetoamide-1-hydroxy-3,6-disulfonaphthyl-2-azo) phenoxy}ethoxy:disodium salt.

A compound represented by formula (I) of the present invention and a coupler for use in the present invention can be polymers. That is, the compound or the coupler may be a polymer which is derived from a monomer represented by formula (M-1) below and has a repeating unit represented by formula (P-1), or a copolymer with at least one type of a non-color-forming monomer which has no ability to couple with an oxidized form of an aromatic primary amine developing agent and contains at least one ethylene group. In this case, two or more types of a monomer represented by formula (M-1) may be simultaneously polymerized.

Formula (M-1)

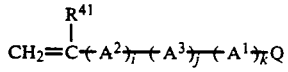

Formula (P-1)

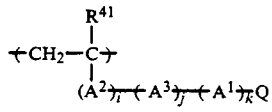

wherein $R^{41}$ represents a hydrogen atom, a lower alkyl group having 1 to 4 carbon atoms, or a chlorine atom, $A^1$ represents —CONH—, —NHCONH—, —NH-$CO_2$—, —$CO_2$—, $SO_2$—, —CO—, —NHCO—, —$SO_2$NH—, —NH$SO_2$—, —OCO—, —OCONH—, —NH—, or —O—, $A^2$ represents —CONH— or —COO—, $A^3$ represents a substituted or nonsubstituted alkylene group having 1 to 10 carbon atoms, an aralkylene group, or a substituted or nonsubstituted arylene group. The alkylene group may be straight-chain or branched.

(Examples of the alkylene group are methylene, methylmethylene, dimethylmethylene, dimethylene, trimethylene, tetramethylene, pentamethylene, hexamethylene, and decylmethylene, an example of the aralkylene group is benzylidene, and examples of the arylene group are phelene and naphthylene.)

Q represents a compound moiety or a coupler moiety represented by formula (I) or (II) and may combine with any position of the substituents already described above for these moieties.

Each of i, j, and k represents 0 or 1, but i, j, and k are not simultaneously 0.

Examples of a substituent for an alkylene group, an aralkylene group, or an arylene group represented by $A^3$ are an aryl group (e.g., phenyl and naphthyl), a nitro group, a hydroxyl group, a cyano group, a sulfo group, an alkoxy group (e.g., methoxy), an aryloxy group (e.g., phenoxy), an acyloxy group (e.g., acetoxy and benzoyloxy), an acylamino group (e.g., acetylamino and benzoylamino), a sulfonamide group (e.g., methanesulfonamide), a sulfamoyl group (e.g., methylsulfamoyl), a halogen atom (e.g., fluorine, chlorine, and bromine), a carboxy group, a carbamoyl group (e.g., methylcarbamoyl), an alkoxycarbonyl group (e.g., methoxycarbonyl), and a sulfonyl group (e.g., methanesulfonyl). When two or more of these substituents are present, they may be the same or different.

Examples of the non-color-forming ethylene monomer which does not couple with an oxidized form of an aromatic primary amine developing agent are acrylic acid, °-chloroacrylic acid, °-alkylacrylic acid, esters or amides derived from these acrylic acids, methylenebisacrylamide, vinylester, acrylonitrile, an aromatic vinyl compound, a maleic acid derivative, and vinylpyridines. Two or more types of these non-color-forming ethylene unsaturated monomers can be simultaneously used.

In formula (I), an alkyl group, an alkenyl group, an alkynyl group, an aryl group, and a heterocyclic group represented by $R^1$ and $R^2$ are same as an alkyl group, an alkenyl group, an alkynyl group, an aryl group, and a heterocyclic group described above for $R^{31}$ to $R^{34}$. $R^1$ and $R^2$ may further have various substituents. Representative examples of the substituents are those enumerated above as the substituents for $R^{31}$ to $R^{34}$. A and $R^1$, A and $R^2$, or $R^1$ and $R^2$ may couple with each other to form a ring.

In formula (I), n represents an integer of 1 or more. When n represents an integer of two or more, respective $R^1$'s and $R^2$'s may be the same or different. Most preferably, n is 1.

In formula (I), $—SO_2NHCONR^1R^2$ preferably substitutes any position except for a position on a carbon atom at a coupling position of the coupler moiety A, and may substitute a dye forming portion, a split-off group portion, or both the portions of the coupler.

Practical examples of a compound represented by formula (I) will be presented in Table A, but the present invention is not limited to these examples.

Representative examples of a method of synthesizing the compound of the present invention will be described below. Other compounds can be similarly synthesized.

SYNTHESIS EXAMPLE 1

Synthesis of Exemplified Compound (1)

The compound was synthesized by the following synthesis route.

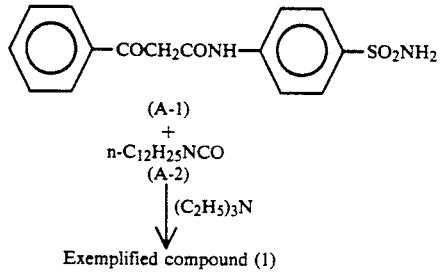

20.0 g of compound (A-1) and 14.6 g of compound (A-2) were mixed in 100 ml of acetonitrile, and the mixture was cooled in an ice-water bath. 7.6 g of triethylamine were dropped over 30 minutes, and the resultant material was cooled and stirred for two hours. The reaction mixture was placed in water and extracted with ethyl acetate. The organic layer was washed with diluted hydrochloric acid and water, and dried on magnesium sulfate. When the drying agent was filtered out and the solvent was distilled off, a yellow oily product resulted. The resultant product was purified through a silica gel column chromatography to obtain 21.3 g of exemplified compound (1) of interest as a light yellow glassy solid.

SYNTHESIS EXAMPLE 2

Synthesis of Exemplified Compound (2)

The compound was synthesized by the following synthesis route.

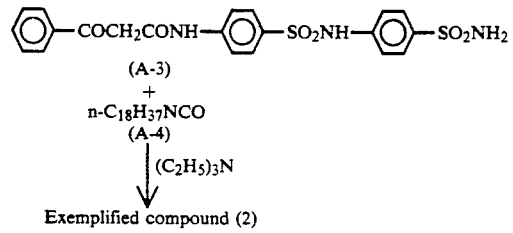

10.0 g of compound (A-3) and 7.5 g of compound (A-4) were mixed in 60 ml of acetonitrile, and the mixture was cooled in an ice-water bath. 2.6 g of triethylamine were dropped over 20 minutes, and the resultant material was cooled and stirred for one hour. The reaction mixture was placed in water and extracted with ethyl acetate. The organic layer was washed with diluted hydrochloric acid and water, and dried on magnesium sulfate. When the drying agent was filtered out and the solvent was distilled off, a yellow oily product resulted. The resultant product was purified through a silica gel column chromatography to obtain 15.3 g of exemplified compound (2) of interest as a light yellow glassy solid.

SYNTHESIS EXAMPLE 3

Synthesis of Exemplified Compound (5)

The compound was synthesized by the following synthesis route.

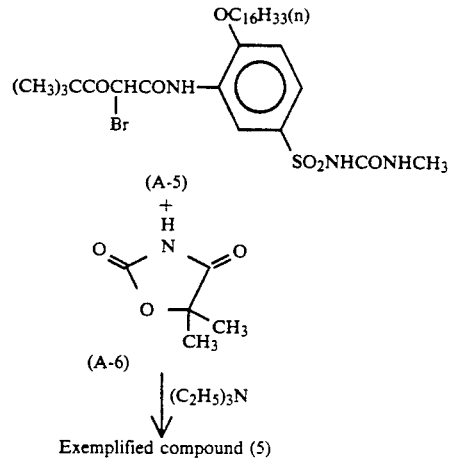

15 0 g of compound (A-5), 6.0 g of compound (A-6), and 5.0 g of triethylamine were mixed in 100 ml of N,N-dimethylformamide, and the mixture was stirred for three hours. The reaction mixture was placed in water and extracted with ethyl acetate. The organic layer was washed with water, a 3% aqueous sodium carbonate solution, and diluted hydrochloric acid, and dried on magnesium sulfate. When the drying agent was filtered out and the solvent was distilled off, a yellow oily product resulted. The resultant product was purified through a silica gel column chromatography to obtain 13.2 g of exemplified compound (5) of interest as a light yellow oily product.

SYNTHESIS EXAMPLE 4

Synthesis of Exemplified Compound (8)

The compound was synthesized by the following synthesis route.

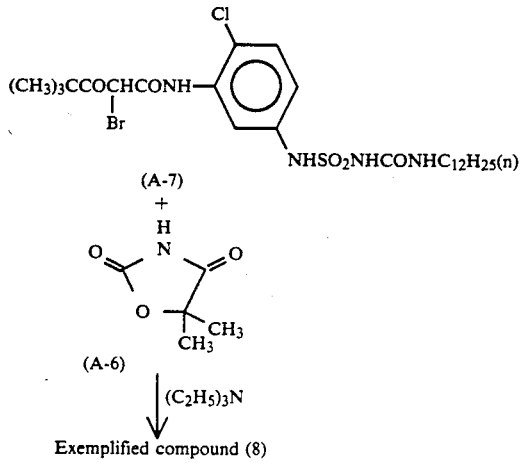

5.7 g of compound (A-7), 2.3 g of compound (A-6), and 2.5 g of triethylamine were mixed in 50 ml of N,N-dimethylformamide, and the mixture was stirred for one hour. The reaction mixture was placed in water and extracted with ethyl acetate. The organic layer was washed with water, a 3% aqueous sodium carbonate solution, and diluted hydrochloric acid, and dried on magnesium sulfate. When the drying agent was filtered out and the solvent was distilled off, a yellow oily product resulted. The resultant product was purified through a silica gel column chromatography to obtain 6.4 g of exemplified compound (8) of interest as a colorless glassy solid.

SYNTHESIS EXAMPLE 5

Synthesis of Exemplified Compound (12)

The compound wa synthesized by the following synthesis route.

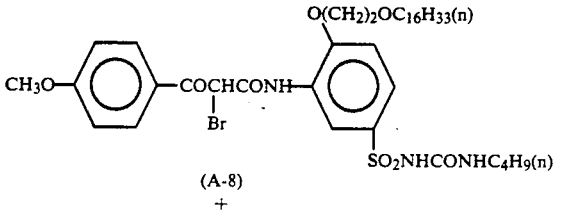

-continued

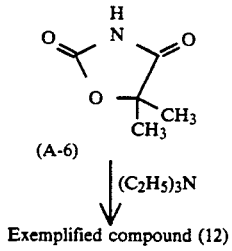

25.0 g of compound (A-8), 8.0 g of compound (A-6), and 7.0 g of triethylamine were mixed in 200 ml of N,N-dimethylformamide, and the mixture was stirred for three hours. The reaction mixture was placed in water and extracted with ethyl acetate. The organic layer was washed with water, a 3% aqueous sodium carbonate solution, and diluted hydrochloric acid, and dried on magnesium sulfate. When the drying agent was filtered out and the solvent was distilled off, a yellow oily product resulted. The resultant product was purified through a silica gel column chromatography to obtain 24.2 g of exemplified compound (12) of interest as a light yellow oily product.

SYNTHESIS EXAMPLE 6

Synthesis of Exemplified Compound (16)

The compound was synthesized by the following synthesis route.

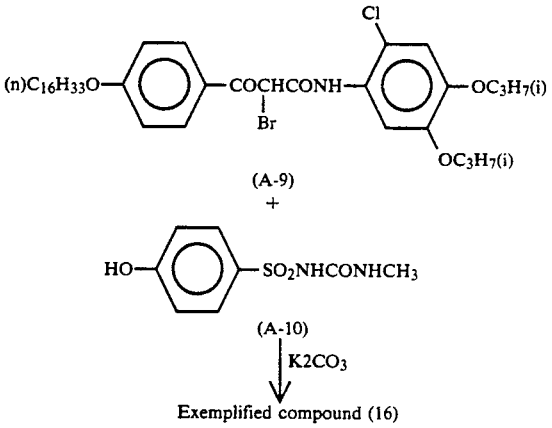

30.0 g of compound (A-9), 6.8 g of compound (A-10), and 12.0 g of potassium carbonate were mixed in 200 ml of N,N-dimethylformamide, and the mixture was stirred for three hours. The reaction mixture was placed in water and extracted with ethyl acetate. The organic layer was washed with water, a 3% aqueous sodium carbonate solution, and diluted hydrochloric acid, and dried on magnesium sulfate. When the drying agent was filtered out and the solvent was distilled off, a yellow oily product resulted. The resultant product was purified through a silica gel column chromatography to obtain 31.5 g of exemplified compound (16) of interest as a colorless glassy solid.

SYNTHESIS EXAMPLE 7

Synthesis of Exemplified Compound (22)

The compound was synthesized by the following synthesis route.

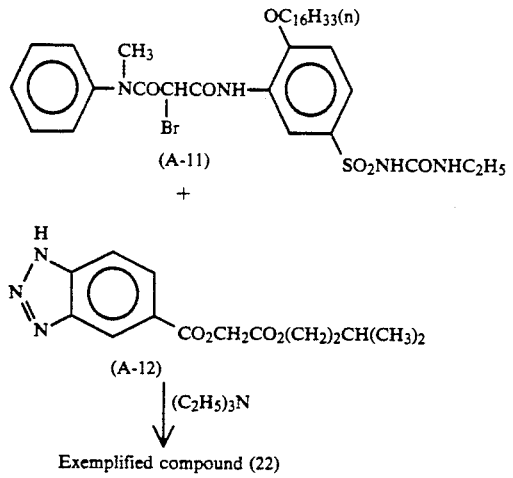

15.5 g of compound (A-11), 13.0 g of compound (A-12), and 5.0 g of triethylamine were mixed in 100 ml of N,N-dimethylformamide, and the mixture was stirred for 1.5 hours. The reaction mixture was placed in water and extracted with ethyl acetate. The organic layer was washed with water, a 3% aqueous sodium carbonate solution, and diluted hydrochloric acid, and dried on magnesium sulfate. When the drying agent was filtered out and the solvent was distilled off, a yellow oily product resulted. The resultant product was purified through a silica gel column chromatography to obtain 14.8 g of exemplified compound (22) of interest as a colorless glassy solid.

SYNTHESIS EXAMPLE 8

Synthesis of Exemplified Compound (24)

The compound was synthesized by the following synthesis route.

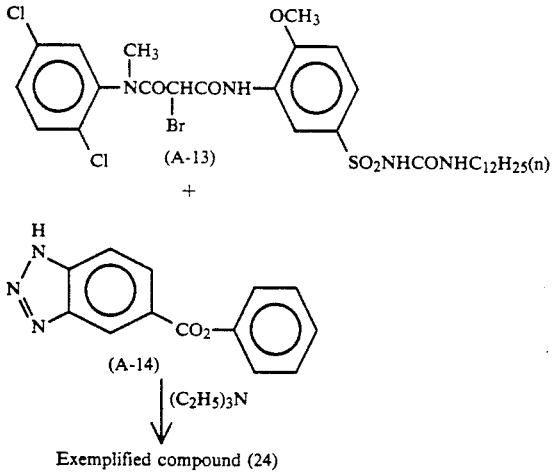

8.0 g of compound (A-13), 5.7 g of compound (A-14), and 2.7 g of triethylamine were mixed in 100 ml of N,N-dimethylformamide, and the mixture was stirred for two hours. The reaction mixture was placed in water and extracted with ethyl acetate. The organic layer was washed with water, a 3% aqueous sodium carbonate solution, and diluted hydrochloric acid, and dried on magnesium sulfate. When the drying agent was filtered out and the solvent was distilled off, a yellow oily product resulted. The resultant product was purified through a silica gel column chromatography to obtain 9.5 g of exemplified compound (24) of interest as a colorless glassy solid.

SYNTHESIS EXAMPLE 9

Synthesis of exemplified compound (28)

The compound was synthesized by the following synthesis route.

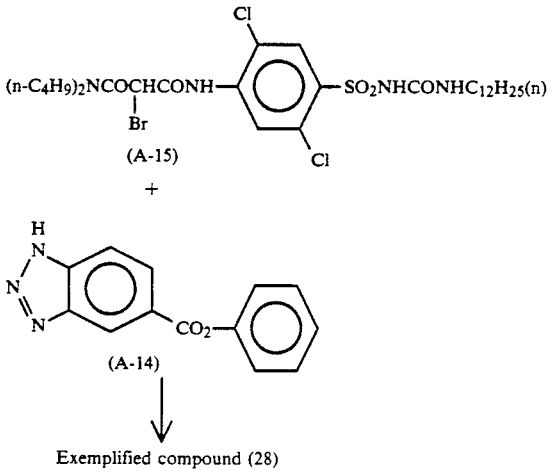

10.0 g of compound (A-15), 6.6 g of compound (A-14), and 3.1 g of triethylamine were mixed in 100 ml of N,N-dimethylformamide, and the mixture was stirred for one hour. The reaction mixture was placed in water and extracted with ethyl acetate. The organic layer was washed with water, a 3% aqueous sodium carbonate solution, and diluted hydrochloric acid, and dried on magnesium sulfate. When the drying agent was filtered out and the solvent was distilled off, a yellow oily product resulted. The resultant product was purified through a silica gel column chromatography to obtain 11.2 g of exemplified compound (28) of interest as a light yellow oily product.

SYNTHESIS EXAMPLE 10

Synthesis of Exemplified Compound (30)

The compound was synthesized by the following synthesis route.

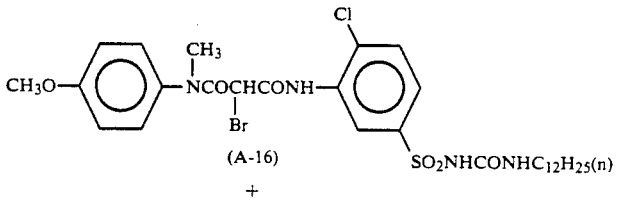

-continued

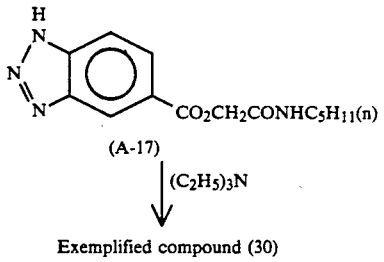

5.5 g of compound (A-16), 4.6 g of compound (A-17), and 2.0 g of triethylamine were mixed in 50 ml of N,N-dimethylformamide, and the mixture was stirred for one hour. The reaction mixture was placed in water and extracted with ethyl acetate. The organic layer was washed with water, a 3% aqueous sodium carbonate solution, and diluted hydrochloric acid, and dried on magnesium sulfate. When the drying agent was filtered out and the solvent was distilled off, a yellow oily product resulted. The resultant product was purified through a silica gel column chromatography to obtain 6.2 g of exemplified compound (30) of interest as a light yellow oily product.

SYNTHESIS EXAMPLE 11

Synthesis of Exemplified Compound (32)

The compound was synthesized by the following synthesis route.

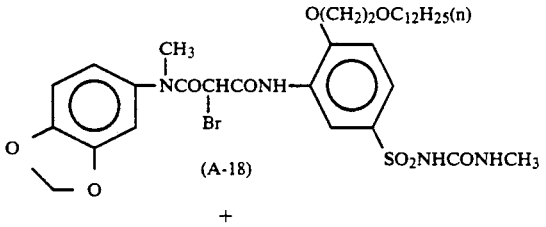

-continued

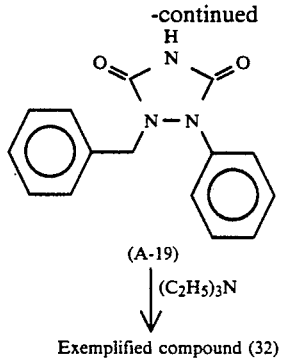

12.1 g of compound (A-18), 8.6 g of compound (A-19), and 3.5 g of triethylamine were mixed in 100 ml of N,N-dimethylformamide, and the mixture was stirred for two hours. The reaction mixture was placed in water and extracted with ethyl acetate. The organic layer was washed with water, a 3% aqueous sodium carbonate solution, and diluted hydrochloric acid, and dried on magnesium sulfate. When the drying agent was filtered out and the solvent was distilled off, a yellow oily product resulted. The resultant product was purified through a silica gel column chromatography to obtain 13.4 g of exemplified compound (32) of interest as a light yellow glassy solid.

SYNTHESIS EXAMPLE 12

Synthesis of Exemplified Compound (36)

The compound was synthesized by the following synthesis route.

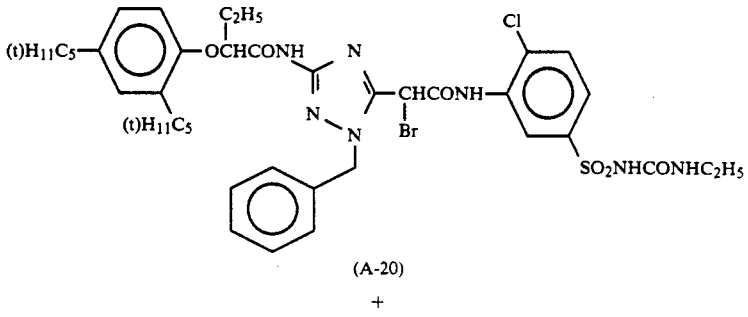

-continued

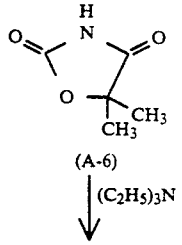

18.0 g of compound (A-20), 5.3 g of compound (A-6), and 4.5 g of triethylamine were mixed in 200 ml of N,N-dimethylformamide, and the mixture was stirred for three hours. The reaction mixture was placed in water and extracted with ethyl acetate. The organic layer was washed with water, a 3% aqueous sodium carbonate solution, and diluted hydrochloric acid, and dried on magnesium sulfate. When the drying agent was filtered out and the solvent was distilled off, a yellow oily product resulted. The resultant product was purified through a silica gel column chromatography to obtain 17.6 g of exemplified compound (36) of interest as a yellow oily product.

SYNTHESIS EXAMPLE 13

Synthesis of Exemplified Compound (38)

The compound was synthesized by the following synthesis route.

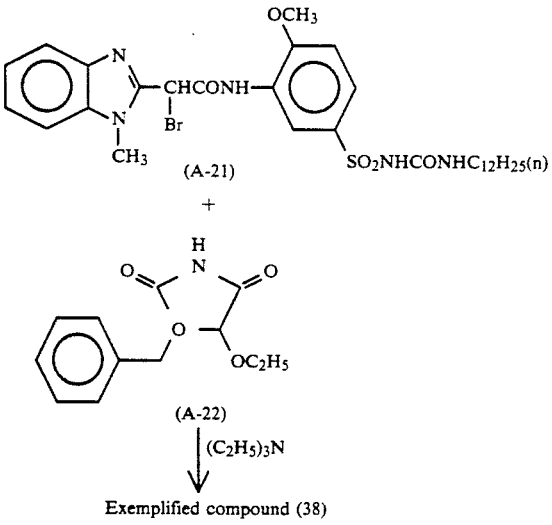

7.3 g of compound (A-21), 5.2 g of compound (A-22), and 2.5 g of triethylamine were mixed in 100 ml of N,N dimethylformamide, and the mixture was stirred for two hours. The reaction mixture was placed in water and extracted with ethyl acetate. The organic layer was washed with water, a 3% aqueous sodium carbonate solution, and diluted hydrochloric acid, and dried on magnesium sulfate. When the drying agent was filtered out and the solvent was distilled off, a yellow oily product resulted. The resultant product was purified through a silica gel column chromatography to obtain 8.1 g of exemplified compound (38) of interest as a colorless oily product.

SYNTHESIS EXAMPLE 14

Synthesis of Exemplified Compound (43)

The compound was synthesized by the following synthesis route.

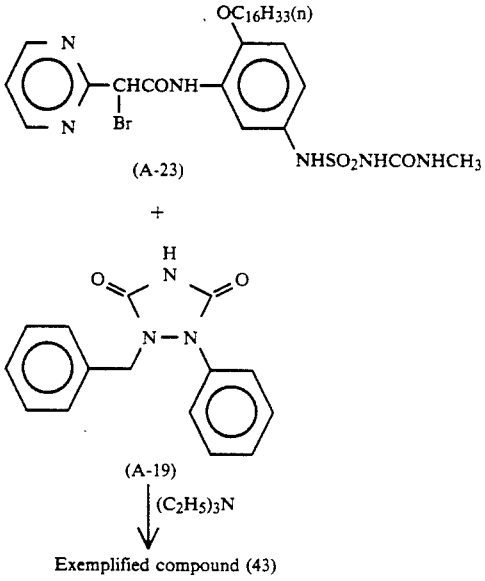

13.2 g of compound (A-23), 10.6 g of compound (A-19), and 4.4 g of triethylamine were mixed in 100 ml of N,N-dimethylformamide, and the mixture was stirred for 2.5 hours. The reaction mixture was placed in water and extracted with ethyl acetate. The organic layer was washed with water, a 3% aqueous sodium carbonate solution, and diluted hydrochloric acid, and dried on magnesium sulfate. When the drying agent was filtered out and the solvent was distilled off, a yellow oily product resulted. The resultant product was purified through a silica gel column chromatography to obtain 14.4 g of exemplified compound (43) of interest as a colorless glassy product.

SYNTHESIS EXAMPLE 15

Synthesis of Exemplified Compound (44)

The compound was synthesized by the following synthesis route.

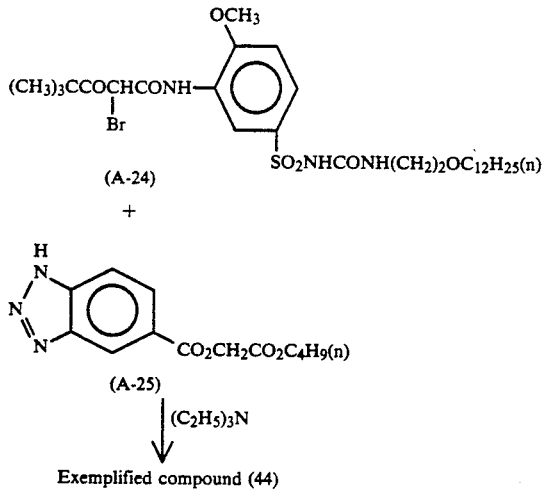

15.3 g of compound (A-24), 13.0 g of compound (A-25), and 5.1 g of triethylamine were mixed in 200 ml of N,N-dimethylformamide, and the mixture was stirred for three hours. The reaction mixture was placed in water and extracted with ethyl acetate. The organic layer was washed with water, a 3% aqueous sodium carbonate solution, and diluted hydrochloric acid, and dried on magnesium sulfate. When the drying agent was filtered out and the solvent was distilled off, a yellow oily product resulted. The resultant product was purified through a silica gel column chromatography to obtain 15.5 g of exemplified compound (44) of interest as a colorless oily product.

SYNTHESIS EXAMPLE 16

Synthesis of Exemplified Compound (46)

The compound was synthesized by the following synthesis route.

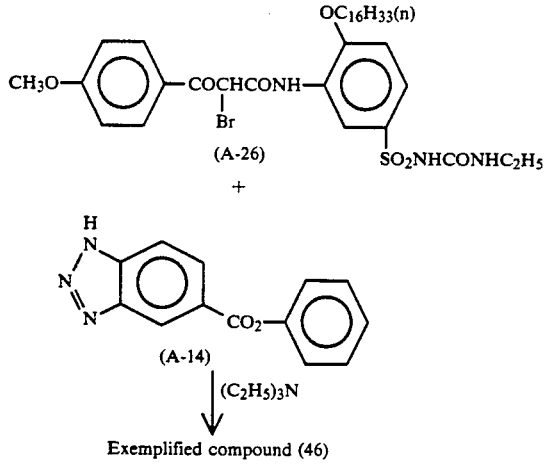

5.7 g of compound (A-26), 3.7 g of compound (A-14), and 1.70 g of triethylamine were mixed in 60 ml of N,N-dimethylformamide, and the mixture was stirred for two hours. The reaction mixture was placed in water and extracted with ethyl acetate. The organic layer was washed with water, a 3% aqueous sodium carbonate solution, and diluted hydrochloric acid, and dried on magnesium sulfate. When the drying agent was filtered out and the solvent was distilled off, a yellow oily product resulted. The resultant product was purified through a silica gel column chromatography to obtain 6.3 g of exemplified compound (46) of interest as a colorless glassy solid.

Although the addition amount of the compound of the present invention depends on the structure and the application of the compound, it is preferably $1\times10^{-7}$ to 1.0 mol, and most preferably $1\times10^{-6}$ to 0.5 mol per mol of silver present in the same or adjacent layer.

The addition amount of a high-boiling point organic solvent to be added to a coupler-containing layer of the present invention is, in weight ratio, 10 to 0, preferably 2 or less, and most preferably 0.7 or less with respect to the total amount of couplers contained in the coupler-containing layer.

Couplers of the present invention may be used singly in a given layer, or two or more types of the couplers may be mixed. In addition, these couplers may be mixed in conventionally known couplers.

The light-sensitive material of the present invention need only have at least one of silver halide emulsion layers, i.e., a blue-sensitive layer, a green-sensitive layer, and a red-sensitive layer formed on a support. The number or order of the silver halide emulsion layers and the non-light-sensitive layers are particularly not limited. A typical example is a silver halide photographic light-sensitive material having, on a support, at least one light-sensitive layers constituted by a plurality of silver halide emulsion layers which are sensitive to essentially the same color sensitivity but has different speed. In a multilayered silver halide color photographic light-sensitive material, the light-sensitive layers are unit light-sensitive layer sensitive to blue, green or red. The unit light-sensitive layers are generally arranged such that red-, green-, and blue-sensitive layers are formed from a support side in the order named. However, this order may be reversed or a layer sensitive to one color may be sandwiched between layers sensitive to another color in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-

20038 or a color mixing inhibitor which is normally used.

As a plurality of silver halide emulsion layers constituting each unit light-sensitive layer, a two-layered structure of high- and low-sensitivity emulsion layers can be preferably used as described in West German Patent 1,121,470 or British Patent 923,045. In this case, layers are preferably arranged such that the sensitivity is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), an order of BH/BL/GL/GH/RH/RL, or an order of BH/BL/GH/GL/RL/RH.

In addition, as described in JP B 55 34932, layers may be arranged from the farthest side from a support in an order of blue-sensitive layer/GH/RH/GL/RL. Furthermore, as described in JP-B-56-25738 and JP-B-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-sensitivity emulsion layer/high-sensitivity emulsion layer/low-sensitivity emulsion layer from the farthest side from a support in a layer sensitive to one color as described in JP-A-59-202464.

In addition, an order of high-sensitivity emulsion layer/low-sensitivity emulsion layer/medium-sensitivity emulsion layer or low-sensitivity emulsion layer/medium-sensitivity emulsion layer/high-sensitivity emulsion layer ma be adopted.

Furthermore, the arrangement can be changed as described above even when four or more layers are formed.

In order to improve color reproducibility, a donor layer (CL) with an interlayer effect, which has a spectral sensitivity distribution different from those of main light-sensitive layers such as BL, GL, and RL, is preferably arranged adjacent to or close to the main light sensitive layers, as described in U.S. Pat. Nos. 4,663,271, 4,705,744, and 4,707,436, JP-A-62-160448, and JP-A-63-89580.

As described above, it is possible to select various layer arrangements and orders in accordance with applications of the light-sensitive material.

A preferable silver halide contained in photographic emulsion layers of the photographic light-sensitive material of the present invention is silver iodobromide, silver iodochloride, or silver iodochlorobromide containing about 30 mol % or less of silver iodide. The most preferable silver halide is silver iodobromide or silver iodochlorobromide containing about 2 mol % to about 10 mol % of silver iodide.

Silver halide grains contained in the photographic emulsion may have regular crystals such as cubic, octahedral, or tetradecahedral crystals, irregular crystals such as spherical or tabular crystals, crystals having crystal defects such as twinned crystal faces, or composite shapes thereof.

The silver halide may consist of fine grains having a grain size of about 0.2 μm or less or large grains having a projected area diameter of about 10 μm, and the emulsion may be either a polydisperse or monodisperse emulsion.

The silver halide photographic emulsion which can be used in the present invention can be prepared by methods described in, for example, Research Disclosure (RD) No. 17,643 (December, 1978), pp. 22 to 23, "I. Emulsion preparation and types", RD No. 18,716 (November, 1979), page 648, and RD No. 307,105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V.L. Zelikman et al., "Making and Coating Photographic Emulsion", Focal Press, 1964.

Monodisperse emulsions described in, for example, U.S Pat. Nos. 3,574,628 and 3,655,394 and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226, 4,414,310, 4,433,048, and 4,499,520, and British Patent 2,112,157.

The crystal structure may be uniform, may have different halogen compositions in the interior and the surface layer thereof, or may be a layered structure. Alternatively, a silver halide having a different composition may be bonded by an epitaxial junction or a compound except for a silver halide such as silver rhodanide or zinc oxide may be bonded. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion is normally subjected to physical ripening, chemical ripening, and spectral sensitization steps before it is used. Additives for use in these steps are described in Research Disclosure Nos. 17,643, 18,716, and 307,105 and they are summarized in the following table.

In the light-sensitive material of the present invention, two or more types of emulsions different in at least one characteristic of a grain size, a grain size distribution, a halogen composition, a grain shape, and sensitivity can be mixed in one layer.

A surface-fogged silver halide grain described in U.S. Pat. No. 4,082,553, an internally fogged silver halide grain described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed in either a non-exposed portion or an exposed portion of the light-sensitive material. A method of preparing the internally fogged or surface-fogged silver halide grain is described in U.S. Patent 4,626,498 or JP-A-59-214852.

A silver halide which forms the core of an internally fogged core/shell type silver halide grain may have the same halogen composition as or a different halogen composition from that of the other portion. Examples of the internally fogged or surface-fogged silver halide are silver chloride, silver chlorobromide, silver iodobromide, and silver chloroiodobromide. Although the grain size of these fogged silver halide grains is not particularly limited, an average grain size is 0.01 to 0.75 μm, and most preferably, 0.05 to 0.6 μm. The grain shape is also not particularly limited but may be a regular grain shape. Although the emulsion may be a polydisperse emulsion, it is preferably a monodisperse emulsion (in which at least 95% in weight or number of silver halide grains have a grain size falling within the range of ±40% of an average grain size).

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm.

The fine grain silver halide can be prepared by a method similar to a method of preparing normal light-sensitive material silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain containing layer preferably contains a colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table I.

TABLE I

| Additives | RD17643 Dec., 197B | RD18716 Nov., 1979 | RD307105 Nov., 1989 |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pp. 23–24 | page 648, right column to page 649, right column | pp. 866–868 |
| 4. Brighteners | page 24 | page 647, right column | page 868 |
| 5. Antifoggants and stabilizers | pp. 24–25 | page 649. right column | pp. 868–870 |
| 6. Light absorbent. filter dye. ultraviolet absorbents | pp. 25–26 | page 649, right column to page 650. left column | page 873 |
| 7. Stain preventing agents | page 25, right column | page 650. left to right columns | page 872 |
| 8. Dye image stabilizer | page 25 | page 650, left column | page 872 |
| 9. Hardening agents | page 26 | page 651. left column | pp. 874–875 |
| 10. Binder | page 26 | page 651. left column | pp. 875–874 |
| 11. Plasticizers. lubricants | page 27 | page 650, right column | page 876 |
| 12. Coating aids. surface active agents | pp. 26–27 | page 650, right column | pp. 875–876 |
| 13. Antistatic agents | page 27 | page 650, right column | pp. 876–877 |
| 14. Matting agent | | page 650, right column | pp. B78–879 |

In order to prevent degradation in photographic properties caused by formaldehyde gas, a compound which can react with and fix formaldehyde described in U.S. Pat. Nos. 4,411,987 or 4,435,503 is preferably added to the light-sensitive material.

The light-sensitive material of the present invention preferably contains mercapto compounds described in U.S. Pat. Nos. 4,740,454 and 4,788,132, JP-A-62-18539, and JP-A-1-283551.

The light-sensitive material of the present invention preferably contains compounds for releasing a fogging agent, a development accelerator, a silver halide solvent, or precursors thereof described in JP-A-1-106052 regardless of a developed silver amount produced by the development.

The light-sensitive material of the present invention preferably contains dyes dispersed by methods described in WO 88/04794 and JP-A-1-502912 or dyes described in EP 317,308A, U.S. Pat. No. 4,420,555, and JP-A-1-259358.

Various color couplers can be used in the present invention, and specific examples of these couplers are described in patents described in above-mentioned Research Disclosure (RD), No. 17643, VII—C to VII-G and RD No. 307105, VII—C to VII-G.

Preferred examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, compounds described in e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No.

24230 (June 1984), JP-A-60-43659, JP-A-61-72238, JP-A 60-35730, JP-A-55-118034, and JP-A-60-185951, U.S. Pat. Nos. 4,500,630, 4,540,654, and 4,565,630, and WO No. 88/04795.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, EP Disclosure 3,329,729, EP 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658.

In addition, it is possible to use pyrazoloazole-based couplers described in JP-A-64-553, JP-A-64-554, JP-A-64-555, and JP-A-64-556, and an imidazole-based coupler described in U.S. Pat. No. 4,818,672.

Typical examples of a polymerized dye-forming coupler are described in U.S. Pat. Nos. 3,451,820, 4,080,221, 4,367,282, 4,409,320, and 4,576,910, British Patent 2,102,173, and EP 341,188A.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Preferable examples of a colored coupler for correcting additional, undesirable absorption of a colored dye are those described in Research Disclosure No. 17643, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Couplers releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Bleaching accelerator releasing couplers described in, e.g., RD Nos. 11449 and 24241 and JP-A-61-201247 can be effectively used to reduce a time required for a treatment having a bleaching function. This effect is remarkable especially when the coupler is added to a light-sensitive material using the tabular silver halide grains described above.

Preferable examples of a coupler for imagewise releasing a nucleating agent or a development accelerator, at the developing stage, are described in British Patents 2,097,140 and 2,131,188, JP-A-59-157638, and JP-A-59-170840. In addition, compounds for releasing a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; a legend releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be added to the light-sensitive material by various known dispersion methods.

Examples of a high-boiling organic solvent to be used in the oil-in-water dispersion method are described in e.g. U.S. Pat. No. 2,322,027. Examples of a high-boiling organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl)phthalate, bis(2,4-di-t-amylphenyl)isophthalate, bis(1,1-diethylpropyl)phthalate), phosphates or phosphonates (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoates (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearylalcohol and 2,4-di-tert-amylphenol), aliphatic carboxylates (e.g., bis(2-ethylhexyl)sebacate, dioctylazelate, glyceroltributylate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethylacetate, and dimethylformamide.

Steps and effects of a latex dispersion method and examples of a loadable latex are described in, e.g., U.S. Pat. No. 4,199,363 and West German Patent Application (OLS) Nos. 2,541,274 and 2,541,230.

Various types of an antiseptic agent or a mildewproofing agent are preferably added to the color light-sensitive material of the present invention. Examples of the antiseptic agent and the mildewproofing agent are 1,2-benzisothiazoline-3-one, n-butyl-p-hydroxybenzoate, phenol, 4-chloro-3.5-dimethylphenol, 2-phenoxyethanol, and 2-(4-thiazolyl)benzimidazole described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, color paper, a color positive film, and color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material using the photographic emulsion of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{\frac{1}{2}}$ is preferably 30 sec. or less, and more preferably, 20 sec. or less. The film thickness means a film thickness measured under moisture conditioning at a temperature of 25° C. and a relative humidity of 55% (two days). The film swell speed $T_{\frac{1}{2}}$ can be measured in accordance with a known method in the art. For example, the film swell speed $T_{\frac{1}{2}}$ can be measured by using a swell meter described in Photographic Science & Engineering, A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, $T_{\frac{1}{2}}$ is defined as a time required for reaching ½ of the saturated film thickness.

The film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation: (maximum swell film thickness−film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, the left to right columns, page 615, and RD. No. 307105, pp. 880 and 881.

A color developer used in development of the light-sensitive material of the present invention is an aqueous alkaline solution containing as a main component, preferably, an aromatic primary amine-based color developing agent. As the color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. Of these compounds, 3-methyl-4-amino-N-ethyl-N-β-hydroxyethylaminiline sulfate is most preferred. These compounds can be used in a combination of two or more thereof in accordance with the application.

In general, the color developer contains a pH buffering agent such as a carbonate, a borate, or a phosphate of an alkali metal, and a development restrainer or an antifoggant such as a bromide, an iodide, a benzimidazole, a benzothiazoe, or a mercapto compound. If necessary, the color developer may also contain a preservative such as hydroxylamine, diethylhydroxylamine, a hydrazine sulfite, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine., a dye forming coupler; a competing coupler; a fogging agent such as sodium boron hydride; an auxiliary developing agent such as 1-phenyl-3-pyrazolidone; a viscosity imparting agent; and a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be singly or in a combination of two or more thereof.

The pH of the color and black-and-white developers is generally 9 to 12. Although a replenishment amount of the developer depends on a color photographic light-sensitive material to be processed, it is generally 3 liters or less per $m^2$ of the light-sensitive material. The replenishment amount can be decreased to be 500 ml or less by decreasing a bromide ion concentration in a replenishing solution. In order to decrease the replenishment amount, a contact area of a processing tank with air is preferably decreased to prevent evaporation and oxidation of the solution upon contact with air. The replenishment amount can be decreased by using a means capable of suppressing an accumulation amount of bromide ions in the developer.

A contact area of a photographic processing solution with air in a processing tank can be represented by an aperture defined below:

$$\text{Aperture} = \frac{\text{contanct area (cm}^2\text{) of processing solution with air}}{\text{volume (cm}^3\text{) of processing solution}}$$

The above aperture is preferably 0.1 or less, and more preferably, 0.001 to 0.05. In order to reduce the aperture, a shielding member such as a floating cover may be provided on the liquid surface of the photographic processing solution in the processing tank. In addition, a method of using a movable cover described in JP-A-1-82033 or a slit developing method described in JP-A-63-216050 may be used. The aperture is preferably reduced not only in color and black-and-white development steps but also in all subsequent steps, e.g., bleaching, bleach-fixing, fixing, washing, and stabilizing steps. In addition, a replenishing amount can be reduced by using a means of suppressing storage of bromide ions in the developing solution.

A color development time is normally two to five minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are a compound of a multivalent metal such as iron(III), peroxides; quinones; and a nitro compound. Typical examples of the bleaching agent are an organic complex salt of iron(III), e.g., a complex salt of an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-53-95631, JP-A-53-104232, JP-A-53-124424, and JP-A-53-141623, and JP-A-53-28426, and Research Disclosure No. 17,129 (July, 1978); a thiazolidine derivative described in JP-A-50-140129; thioarea derivative described in JP-B-45-8506, JP-A-52-20832, JP-A-53-32735, and U.S Pat. No. 3,706,561; a iodide salt described in West German Patents 1,127,715 and JP-A-58-16235; polyoxyethylene compounds descried in West German Patents 977,410 and 2,748,430; a polyamine compound described in JP-B-45-8836; compounds descried in JP-A-49-40943, JP-A 49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid or propionic acid.

Examples of the fixing agent are thiosulfate a thiocyanate, a thioether-based compound, a thiourea and a large amount of an iodide. Of these compounds, a thiosulfate, especially, ammonium thiosulfate can be used in the widest range of applications. In addition, a combination of thiosulfate and a thiocyanate, a thioether-based compound, or thiourea is preferably used. As a preservative of the bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of strengthening the stirring are a method of colliding a jet stream of the processing solution against the emulsion surface of the light-sensitive material described in JP-A-62-183460, a method of increasing the stirring effect using rotating means described in JP A 62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyor means described in JP-A-60-191257, JP-A-191258, or JP-A-60-191259. As described in JP-A-60-191257, this conveyor means can significantly reduce carry-over of a processing solution from a pre-bath to a post-bath, thereby effectively preventing degradation in performance of the processing solution. This effect significantly shortens especially a processing time in each processing step and reduces a processing solution replenishing amount.

The photographic light-sensitive material of the present invention is normally subjected to washing and/or stabilizing steps after desilvering. An amount of water used in the washing step can be arbitrarily determined over a broad range in accordance with the properties (e.g., a property determined by use of a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248-253 (May, 1955).

According to the above-described multi-stage counter-current scheme, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilizing is sometimes performed subsequently to washing. An example is a stabilizing bath containing a dye stabilizing agent and a surface-active agent to be used as a final bath of the photographic color light-sensitive material. Examples of the dye stabilizing agent are an aldehyde such as formalin and glutaraldehyde, an N-methylol compound, hexamethylenetetramine, and an aldehyde sulfurous acid adduct. Various chelating agents or antifungal agents can be added in the stabilizing bath.

An overflow solution produced upon washing and/or replenishment of the stabilizing solution can be reused in another step such as a desilvering step.

In the processing using an automatic developing machine or the like, if each processing solution described above is condensed by evaporation, water is preferably added to correct condensation.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and an urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide light-sensitive material of the present invention can be applied to thermal development light-sensitive materials described in, e.g., U.S. Pat. No. 4,500,626, JP-A-60-133449, JP-A-59-218443, JP-A-61-238056, and EP 210,660A2.

The silver halide color photographic light-sensitive material of the present invention contains a novel coupler having a high dye formation rate and a high color forming density and can achieve an improved sharpness of an image and a high sensitivity.

The present invention will be described in more detail below by way of its examples, but the present invention is not limited to these examples. Note that the structures of comparative couplers will be presented in Table B.

EXAMPLE 1

Layers having the following compositions were coated on a triacetylcellulose film support having an undercoating layer to form a light-sensitive material 101.

| | |
|---|---|
| (1) Emulsion layer | |
| Tabular emulsion (silver iodide = 5 mol %, average aspect ratio = 7.5, average grain size = 0.65 μm) | silver 1.00 g/m$^2$ |
| Comparative coupler C-1 | 0.90 g/m$^2$ |
| Tricresylphosphate | 0.45 g/m$^2$ |
| Gelatin | 2.80 g/m$^2$ |
| (2) Protective layer | |
| Sodium 2,4-dichloro-6-hydroxy-s-triazine | 0.10 g/m$^2$ |
| Gelatin | 1.8 g/m$^2$ |

Samples 102-104

The comparative coupler (C-1) added to the emulsion layer of the sample 101 was replaced with equimolar amounts of couplers listed in Table 1 below, thereby forming samples 102 to 104.

These samples were exposed to white light for sensitometry and subjected to the following color development. The yellow density of each developed sample was measured to obtain a relative sensitivity represented by the logarithm of a reciprocal of an exposure amount for yielding a density of (fog+0.2), a maximum color forming density, and a gamma (line+slope obtained by connecting a point of fog+0.2 and a point of fog+1.2). The results are summarized in Table 1.

As is apparent from Table 1, each sample of the present invention is high in sensitivity, contrast, and white density as compared with the comparative examples.

The development was performed at 38° C. under the following conditions.

| | |
|---|---|
| 1. Color development | 2 min. 15 sec. |
| 2. Bleaching | 6 min. 30 sec. |
| 3. Washing | 3 min. 15 sec. |
| 4. Fixing | 6 min. 30 sec. |
| 5. Washing | 3 min. 15 sec. |
| 6. Stabilization | 3 min. 15 sec. |

The compositions of the processing solutions will be presented below.

| | |
|---|---|
| Color developing solution: | |
| Sodium nitrilo triacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N-ethyl-N-β-hydroxylethylamino)-2-methylaniline sulfate | 4.5 g |
| Water to make | 1.0 l |
| Bleaching solution | |
| Ammonium bromide | 160.0 g |
| Ammonia water (28%) | 25.0 ml |
| Ethylenediamine-sodium tetraacetate iron salt | 130 g |
| Glacial acetic acid | 14 ml |
| Water to make | 1.0 l |
| Fixing solution: | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1.0 l |
| Stabilizing solution: | |
| Formalin | 2.0 ml |
| Water to make | 1.0 l |

EXAMPLE 2

The tabular emulsion of the emulsion layer of the sample 101 was replaced with 0.50 g/m$^2$ (silver content) of a monodisperse octahedral emulsion (silver iodide=11 mol %, a core/shell type grain having 20 mol % of core and 2 mol % of shell, average grain size=0.4 μm, variation coefficient of grain size=0.14) and the coupler (C-1) was replaced with a coupler (C-3), thereby forming a sample 201.

The coupler (C-3) of the sample 201 was replaced with equimolar amounts of couplers listed in Table 2 to form samples 202 to 206.

These samples were evaluated following the same procedures as in Example 1, and the results of photographic performance are summarized in Table 2 below.

As is apparent from Table 2, each sample using the coupler of the present invention is high in sensitivity, contrast, and color forming density.

EXAMPLE 3

0.90 g/m$^2$ of the coupler C-3 of the sample 201 was replaced with 0.80 g/m$^2$ of a coupler C-5 and 0.45 g/m$^2$ of tricresylphosphate was replaced with 0.20 g/m$^2$ of dibutylphthalate, thereby forming a sample 301.

The coupler (C-5) of the sample 301 was replaced with equimolar amounts of couplers listed in Table 3 to form samples 302 to 305.

These samples were evaluated following the same procedures as in Example 1. The results are summarized in Table 3 below.

As is apparent from Table 3, each sample using the coupler of the present invention is high in sensitivity, contrast, and color forming density.

EXAMPLE 4

A plurality of layers having the following compositions were coated on an undercoated cellulose triacetate support to form sample 401 as a multilayered color photosensitive material.

Compositions of Photosensitive Layers

Numerals corresponding to each component indicates a coating amount represented in units of g/m$^2$. The coating amount of a silver halide is represented by the coating amount of silver. The coating amount of a sensitizing dye is represented in units of mols per mol of a silver halide in the same layer.

Sample 401

| | | |
|---|---|---|
| Layer 1: Antihalation layer | | |
| Black colloidal silver | silver | 0.18 |
| Gelatin | | 1.40 |
| Layer 2: Interlayer | | |
| 2,5-di-t-pentadecylhydroquinone | | 0.18 |
| EX-1 | | 0.18 |
| EX-3 | | 0.020 |
| EX-12 | | $2.0 \times 10^{-5}$ |
| U-1 | | 0.060 |
| U-2 | | 0.080 |
| U-3 | | 0.10 |
| HBS-1 | | 0.10 |
| HBS-2 | | 0.020 |
| Gelatin | | 0.80 |
| Layer 3: 1st red-sensitive emulsion layer | | |
| Emulsion A | silver | 0.25 |
| Emulsion B | silver | 0.25 |
| Sensitizing dye I | | $6.9 \times 10^{-5}$ |
| Sensitizing dye II | | $1.8 \times 10^{-5}$ |
| Sensitizing dye III | | $3.1 \times 10^{-4}$ |
| EX-2 | | 0.17 |
| EX-10 | | 0.020 |
| EX-14 | | 0.17 |
| U-1 | | 0.070 |
| U-2 | | 0.050 |
| U-3 | | 0.070 |
| HBS-1 | | 0.060 |
| Gelatin | | 0.70 |
| Layer 4: 2nd red-sensitive emulsion layer | | |
| Emulsion G | silver | 0.80 |
| Sensitizing dye I | | $5.1 \times 10^{-5}$ |
| Sensitizing dye II | | $1.4 \times 10^{-5}$ |
| Sensitizing dye III | | $2.3 \times 10^{-4}$ |
| EX-2 | | 0.20 |
| EX-3 | | 0.050 |
| EX-10 | | 0.015 |
| EX-14 | | 0.20 |
| EX-15 | | 0.050 |
| C-6 | | 0.011 |
| U-1 | | 0.070 |
| U-2 | | 0.050 |
| U-3 | | 0.070 |
| Gelatin | | 1.10 |
| Layer 5: 3rd red-sensitive emulsion layer | | |
| Emulsion D | silver | 1.30 |
| Sensitizing dye I | | $5.4 \times 10^{-5}$ |
| Sensitizing dye II | | $1.4 \times 10^{-5}$ |
| Sensitizing dye III | | $2.4 \times 10^{-4}$ |
| EX-2 | | 0.097 |
| EX-3 | | 0.010 |
| EX-4 | | 0.080 |
| EX-8 | | 0.090 |
| HBS-1 | | 0.11 |
| HBS-2 | | 0.05 |
| Gelatin | | 1.00 |
| Layer 6: Interlayer | | |
| EX-5 | | 0.040 |
| HBS-1 | | 0.020 |
| Gelatin | | 0.50 |
| Layer 7: 1st green-sensitive emulsion layer | | |
| Emulsion A | silver | 0.15 |

-continued

| | |
|---|---|
| Emulsion B | silver 0.15 |
| Sensitizing dye IV | $3.0 \times 10^{-5}$ |
| Sensitizing dye V | $1.0 \times 10^{-4}$ |
| Sensitizing dye VI | $3.8 \times 10^{-4}$ |
| EX-1 | 0.021 |
| EX-6 | 0.26 |
| EX-7 | 0.030 |
| C-6 | 0.025 |
| HBS-1 | 0.10 |
| HBS-3 | 0.010 |
| Gelatin | 0.63 |
| Layer 8: 2nd green-sensitive emulsion layer | |
| Emulsion C | silver 0.45 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |
| EX-6 | 0.094 |
| EX-7 | 0.026 |
| C-6 | 0.018 |
| HBS-1 | 0.16 |
| HBS-3 | $8.0 \times 10^{-3}$ |
| Gelatin | 0.50 |
| Layer 9: 3rd green-sensitive emulsion layer | |
| Emulsion E | silver 1.05 |
| Sensitizing dye IV | $3.5 \times 10^{-5}$ |
| Sensitizing dye V | $8.0 \times 10^{-5}$ |
| Sensitizing dye VI | $3.0 \times 10^{-4}$ |
| EX-1 | 0.013 |
| EX-11 | 0.065 |
| EX-13 | 0.019 |
| C-6 | 0.015 |
| HBS-1 | 0.10 |
| HBS-2 | 0.05 |
| Gelatin | 1.00 |
| Layer 10: Yellow filter layer | |
| Yellow colloidal silver | silver 0.050 |
| EX-5 | 0.080 |
| HBS-1 | 0.030 |
| Gelatin | 0.50 |
| Layer 11: 1st blue-sensitive emulsion layer | |
| Emulsion A | silver 0.080 |
| Emulsion B | silver 0.070 |
| Emulsion F | silver 0.070 |
| Sensitizing dye VII | $3.5 \times 10^{-4}$ |
| C-6 | 0.042 |
| EX-9 | 0.72 |
| HBS-1 | 0.28 |
| Gelatin | 1.10 |
| Layer 12: 2nd blue-sensitive emulsion layer | |
| Emulsion G | silver 0.30 |
| Sensitizing dye VII | $2.1 \times 10^{-4}$ |
| EX-9 | 0.15 |
| EX-10 | $7.0 \times 10^{-3}$ |
| HBS-1 | 0.050 |
| Gelatin | 0.78 |
| Layer 13: 3rd blue-sensitive emulsion layer | |
| Emulsion H | silver 0.60 |
| Sensitizing dye VII | $2.2 \times 10^{-4}$ |
| EX-9 | 0.20 |
| HBS-1 | 0.070 |
| Gelatin | 0.69 |
| Layer 14: 1st protective layer | |
| Emulsion I | silver 0.20 |
| U-4 | 0.11 |
| U-5 | 0.17 |
| HBS-1 | $5.0 \times 10^{-2}$ |
| Gelatin | 1.00 |
| Layer 15: 2nd protective layer | |
| H-1 | 0.40 |
| B-1 (diameter = 1.7 μm) | $5.0 \times 10^{-2}$ |
| B-2 (diameter = 1.7 μm) | 0.10 |
| B-3 | 0.10 |
| S-1 | 0.20 |
| Gelatin | 1.20 |

In addition, in order to improve storage stability, processability, a resistance to pressure, antiseptic and mildewproofing properties, antistatic properties, and coating properties, W-1, W-2, W-3, B-4, B-5, F-1, F-2, F-3, F-4, F-5, F-6, F-7, F-8, F-9, F-10, F-11, F-12, F-13, iron salt, lead salt, gold salt, platinum salt, iridium salt, and rhodium salt were added to all of the above layers.

Samples 402–410

The coupler (C-6) of the layers 4, 7, 8, 9, and 11 of the sample 401 were replaced with comparative couplers and couplers of the present invention at molar ratios listed in Table 4, thereby forming samples 402 to 410. The addition amounts of the couplers were determined such that substantially equal sensitivities and gammas were obtained when the following color development was performed after white imagewise exposure.

These samples were exposed imagewise with green light and subjected to the following color development. Values obtained by subtracting a yellow fog density from a yellow density at a magenta density (fog+1.0) are shown as a white turbidity in Table 4.

An MTF value of a cyan image at 25 cycle/mm was obtained. The measurement of the MTF value was performed in accordance with the method described in Mies, "The Theory of Photographic Process 3rd. ed.," Macmillan Co., Ltd.

| Processing Method | | | | |
|---|---|---|---|---|
| Process | Time | Temperature | Quantity of replenisher* | Tank volume |
| Color | 3 min. 15 sec. | 37.8° C. | 25 ml | 10 l |
| Bleaching | 45 sec. | 38° C. | 5 ml | 4 l |
| Bleach-fixing (1) | 45 sec. | 38° C. | — | 4 l |
| Bleach-fixing (2) | 45 sec. | 38° C. | 30 ml | 4 l |
| Washing (1) | 20 sec. | 38° C. | — | 2 l |
| Washing (2) | 20 sec. | 38° C. | 30 ml | 2 l |
| Stabilization | 20 sec. | 38° C. | 20 ml | 2 l |
| Drying | 1 min. | 55° C. | | |

*A quantity of replenisher is a quantity per meter of a 35-mm wide sample

Each of the bleach-fixing and washing steps was performed by a counter flow system piping from (2) to (1), and all of an overflow solution of the bleaching solution was introduced to the bleach-fixing step (2).

In the above processing, an amount of the bleach-fixing solution carried to the washing step was 2 ml per meter of a 35-mm wide photosensitive material.

| | Mother solution (g) | Replenisher (g) |
|---|---|---|
| Color developing solution: | | |
| Diethylenetriamine-pentaacetate | 5.0 | 6.0 |
| Sodium sulfite | 4.0 | 5.0 |
| Potassium carbonate | 30.0 | 37.0 |
| Potassium bromide | 1.3 | 0.5 |
| Potassium iodide | 1.2 mg | — |
| Hydroxylamine sulfate | 2.0 | 3.6 |
| 4-[N-ethyl-N-β-hydroxylethylamino]-2-methylaniline sulfate | 4.7 | 6.2 |
| Water to make | 1.0 l | 1.0 l |
| pH | 10.00 | 10.15 |
| Bleaching solution: | | |
| Ferric ammonium 1,3-diaminopropane-tetraacetate monohydrate | 144.0 | 206.0 |
| 1,3-diaminopropane-tetraacetate | 2.8 | 4.0 |
| Ammonium bromide | 84.0 | 120.0 |
| Ammonium nitrate | 17.5 | 25.0 |

-continued

| | Mother solution (g) | Replenisher (g) |
|---|---|---|
| Ammonia water (27%) | 10.0 ml | 1.8 ml |
| Acetic acid (98%) | 51.1 | 73.0 |
| Water to make | 1.0 l | 1.0 l |
| pH | 4.3 | 3.4 |
| Bleach-fixing solution: | | |
| Ferric ammonium ethylenediamine-tetraacetate dihydrate | 50.0 | — |
| Disodium ethylene-diaminetetraacetate | 5.0 | 25.0 |
| Ammonium sulfite | 12.0 | 20.0 |
| Ammonium thiosulfate aqueous solution (700 g/l) | 290.0 ml | 320.0 ml |
| Ammonia water | 6.0 ml | 15.0 ml |
| Water to make | 1.0 l | 1.0 l |
| pH | 6.8 | 8.0 |
| Washing Solution: | Common for mother solution and replenisher | |

Tap water was supplied to a mixed-bed column filled with an H type strongly acidic cation exchange resin (Amberlite IR-120B: available from Rohm & House Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 150 mg/l of sodium sulfate was added. The pH of the solution fell within the range of 6.5 to 7.5.

| Stabilizing solution: | Common for mother solution and replenisher (g) |
|---|---|
| Formalin (37%) | 1.2 ml |
| Surfactant [$C_{10}H_{21}$—O—$(CH_2CH_2O)_{10}$—H] | 0.4 |
| Ethyleneglycol | 1.0 |
| Water to make | 1.0 l |
| pH | 5.0–7.0 |

As is apparent from Table 4, the coupler of the present invention is highly active and therefore can achieve a satisfactory function as a DIR coupler even with a small addition amount. The coupler is also excellent in color reproducibility represented by the color turbidity and sharpness represented by the MTF value.

The emulsions A, B, C, D, E, F, G, H, and I used in Example 4 are as listed in Table 5 below.

The structures of the compounds used in Examples 1 to 4 will be presented in Table C.

EXAMPLE 5

The coupler C-5 of the layer 12 and the coupler C-7 of the layer 13 of the sample 101 of JP-A-2-854 were replaced with an equimolar amount of the coupler (7), (9), (10), (31), (32), (33), (34), or (36) of the present invention, and the following color development was performed after blue imagewise exposure. As a result, each sample using the coupler of the present invention had a high yellow color forming density and a high gamma.

| Step | Processing Steps Time | Temperature |
|---|---|---|
| 1st development | 6 min. | 38° C. |
| Washing | 2 min. | 38° C. |
| Reversal | 2 min. | 38° C. |

-continued

| Step | Processing Steps Time | Temperature |
|---|---|---|
| Color Development | 6 min. | 38° C. |
| Control | 2 min. | 38° C. |
| Bleaching | 6 min. | 38° C. |
| Fixing | 4 min. | 38° C. |
| Washing | 4 min. | 38° C. |
| Stabilization | 1 min. | room temperature |
| Drying | | |

The compositions of the respective processing solutions were as follows.

| | |
|---|---|
| 1st developing solution | |
| Water | 700 ml |
| Pentasodium nitrilo-N,N,N-trimethylene phosphonate | 2.0 g |
| Sodium sulfite | 20.0 g |
| Hydroquinone monosulfonate | 30.0 g |
| Potassium carbonate (monohydrate) | 30.0 g |
| 1-phenyl-4-methyl-4-hydroxymethyl-3-pyrazolidone | 2.0 g |
| Potassium bromide | 2.5 g |
| Potassium thiocyanate | 1.2 g |
| Potassium iodide (0.1% solution) | 2.0 ml |
| Water to make | 1,000 ml |
| Reversal solution | |
| Water | 700 ml |
| Pentasodium nitrilo-N,N,N-trimethylene phosphonate | 3.0 g |
| Stannous chloride (dihydrate) | 1.0 g |
| p-aminophenyl | 0.1 g |
| Sodium hydroxide | 8.0 g |
| Glacial acetic acid | 15.0 ml |
| Water to make | 1,000 ml |
| Color developing solution | |
| Water | 700 ml |
| Pentasodium nitrilo-N,N,N-trimethylene phosphonate | 3.0 g |
| Sodium sulfite | 7.0 g |
| Trisodium phosphate (dodecahydrate) | 36.0 g |
| Potassium bromide | 1.0 g |
| Potassium iodide (0.1% solution) | 90 mg |
| Sodium hydroxide | 3.0 g |
| Citrazinic acid | 1.5 g |
| N-ethyl-N(β-methane-sulfonamidoethyl)-3-methyl-4-aminoaniline sulfate | 11.0 g |
| 3,6-dithiaoctane-1,8-diol | 1.0 g |
| Water to make | 1,000 ml |
| Control solution | |
| Water | 700 ml |
| Sodium sulfite | 12 g |
| Sodium ethylene-diaminetetraacetate (dihydrate) | 8 g |
| Thioglycerin | 0.4 ml |
| Glacial acetic acid | 3 ml |
| Water to make | 1,000 ml |
| Bleaching solution | |
| Water | 800 ml |
| Sodium ethylenediamine tetraacetate (dihydrate) | 2 g |
| Ammonium ethylenediamine tetraacetate iron (III) (dihydrate) | 120 g |
| Potassium bromide | 100 g |
| Water to make | 1,000 ml |
| Fixing solution | |
| Water | 800 ml |
| Sodium thiosulfate | 80.0 g |
| Sodium sulfite | 5.0 g |
| Sodium bisulfite | 5.0 g |
| Water to make | 1,000 ml |
| Stabilizing Solution | |
| Water | 800 ml |

-continued

| | |
|---|---|
| Formalin (37 wt %) | 5.0 ml |
| Fuji Drywell (surfactant: available from Fuji Photo Film Co. Ltd.) | 5.0 ml |
| Water to make | 1,000 ml |

EXAMPLE 6

As a silver halide color light-sensitive material, the sample No. 214 (multilayered color paper) described in Example 2 of European Patent EPO 355,660A2 (corresponding to JP-A-2-139544 and U.S. Ser. No. 07/393,747) was used. Note that III-10 was used in place of III-23 described in that patent as a bisphenol compound, and the yellow coupler (ExY), the cyan coupler (ExC), the image stabilizer (Cpd-8), the solvent (Solv-6), and the oxonol dye were changed to the following compounds. In addition, compounds listed in Table D below were used as antiseptic agents (mildew-proofing agents).

The yellow coupler of the sample 601 was replaced with the couplers (5), (6), (7), and (8) of the present invention, and development was performed following the same procedures as in Example 2 described above. As a result, a high yellow color forming density was obtained.

EXAMPLE 7

EX-6 of the layers 7 and 8 of the sample 101 of JP-A-2-89045 were replaced with equimolar amounts of couplers (59), (61), (64), (65), (66), (68), and (69) of the present invention, and green imagewise exposure was performed. Thereafter, color development was performed following the same procedures as in Example 5. As a result, each sample using the coupler of the present invention had a high magenta color forming density and a high gamma.

EXAMPLE 8

EX-2 of the layers 3 and 4 of the sample 101 of JP-A-2-89045 were replaced with equimolar amounts of couplers (71), (73), (74), (75), (76), (79), (80), and (81) of the present invention, and red imagewise exposure was performed. Thereafter, color development was performed following the same procedures as in Example 5. As a result, each sample using the coupler of the present invention had a high cyan color forming density and a high gamma.

TABLE 1

| Sample | Coupler | Relative sensitivity | Maximum color forming density | gamma |
|---|---|---|---|---|
| 101 (Comparison) | C-1 | 0.00 | 1.85 | 0.92 |
| 102 (Comparison) | C-2 | 0.01 | 1.87 | 0.93 |
| 103 (Present Invention) | (1) | 0.03 | 2.02 | 0.96 |

TABLE 1-continued

| Sample | Coupler | Relative sensitivity | Maximum color forming density | gamma |
|---|---|---|---|---|
| 104 (Present Invention) | (2) | 0.04 | 2.05 | 1.00 |

TABLE 2

| Sample | Coupler | Relative sensitivity | Maximum color forming density | gamma |
|---|---|---|---|---|
| 201 (Comparison) | C-3 | 0.00 | 1.82 | 1.06 |
| 202 (Comparison) | C-4 | 0.00 | 1.89 | 1.11 |
| 203 (Present Invention) | (5) | 0.05 | 2.16 | 1.29 |
| 204 (Present Invention) | (6) | 0.04 | 2.14 | 1.26 |
| 205 (Present Invention) | (7) | 0.05 | 2.16 | 1.29 |
| 206 (Present Invention) | (11) | 0.03 | 2.12 | 1.25 |

TABLE 3

| Sample | Coupler | Relative sensitivity | Maximum color forming density | gamma |
|---|---|---|---|---|
| 301 (Comparison) | C-5 | 1.91 | 1.91 | 1.04 |
| 302 (Present Invention) | (12) | 0.05 | 2.24 | 1.23 |
| 303 (Present Invention) | (14) | 0.04 | 2.21 | 1.19 |
| 304 (Present Invention) | (15) | 0.05 | 2.23 | 1.22 |
| 305 (Present Invention) | (16) | 0.04 | 2.21 | 1.22 |

TABLE 4

| Sample | Couplers of layers 4, 7, 8, 9, and 11 type | amount | Color turbidity | MTF valve cyan image (25 cycle/mm) |
|---|---|---|---|---|
| 401 (Comparison) | C-6 | 1.0 | 0.29 | 0.58 |
| 402 (Comparison) | C-7 | 0.50 | 0.15 | 0.63 |
| 403 (Comparison) | C-8 | 0.40 | 0.20 | 0.61 |
| 404 (Comparison) | C-9 | 0.50 | 0.16 | 0.63 |
| 405 (Present Invention) | (20) | 0.15 | 0.04 | 0.67 |
| 406 (Present Invention) | (21) | 0.30 | 0.06 | 0.66 |
| 407 (Present Invention) | (22) | 0.30 | 0.05 | 0.66 |
| 408 (Present Invention) | (24) | 0.30 | 0.06 | 0.66 |
| 409 (Present Invention) | (25) | 0.30 | 0.04 | 0.68 |
| 410 (Present Invention) | (28) | 0.30 | 0.06 | 0.66 |

TABLE 5

| | Average AgI content (%) | Average gain size (μm) | Variation coefficient (%) according to gain size | Diameter/thickness ratio | Silver amount ratio (AgI content, %) |
|---|---|---|---|---|---|
| Emulsion A | 4.0 | 0.35 | 18 | 4.0 | Core/shell = 1/3 (13/1), Double structure grain |
| Emulsion B | 8.9 | 0.55 | 14 | 5.5 | Core/shell = 3/7 (25/2), Double structure grain |
| Emulsion C | 10 | 0.60 | 17 | 7.0 | Core/shell = 1/2 (24/3), Double structure grain |
| Emulsion D | 16 | 0.85 | 18 | 7.0 | Core/shell = 4/6 (40/0), Double structure grain |
| Emulsion E | 10 | 0.85 | 17 | 6.0 | Core/shell = 1/2 (24/3), Double structure grain |
| Emulsion F | 4.0 | 0.20 | 14 | 4.0 | Core/shell = 1/3 (13/1), Double structure grain |

TABLE 5-continued
| | Average AgI content (%) | Average gain size (μm) | Variation coefficient (%) according to gain size | Diameter/ thickness ratio | Silver amount ratio (AgI content, %) |
|---|---|---|---|---|---|
| Emulsion G | 14.0 | 0.60 | 17 | 7.0 | Core/shell = 1/2 (42/0), Double structure grain |
| Emulsion H | 14.5 | 1.05 | 18 | 7.5 | Core/shell = 37/63 (34/3), Double structure grain |
| Emulsion I | 1 | 0.07 | 12 | 1 | Uniform grain |
TABLE A
(1)
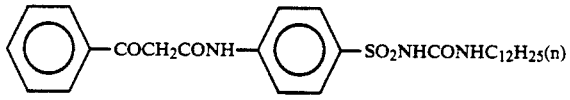
(2)
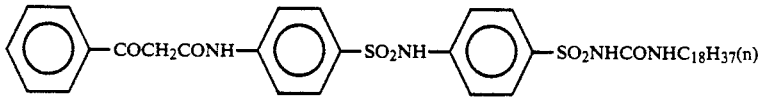
(3)
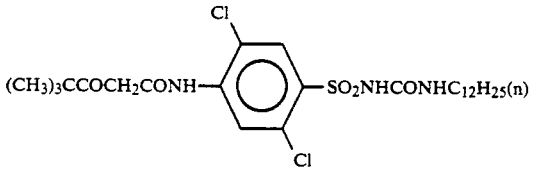
(4)
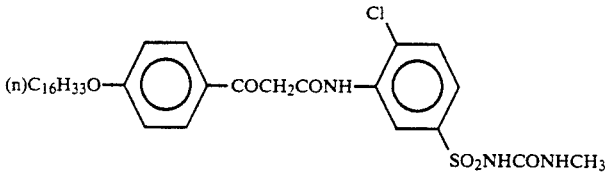
(5)
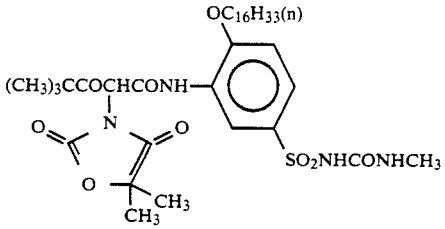
(6)
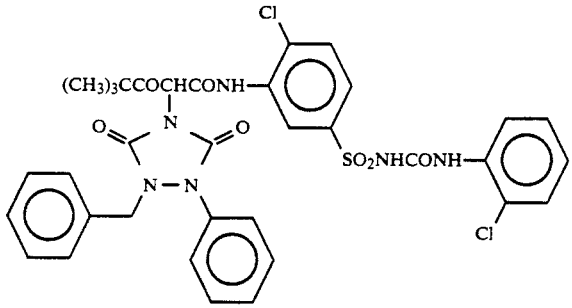
(7)
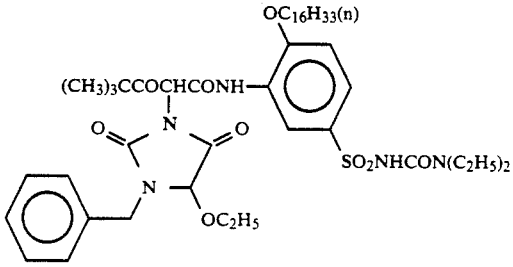

TABLE A-continued
(8)
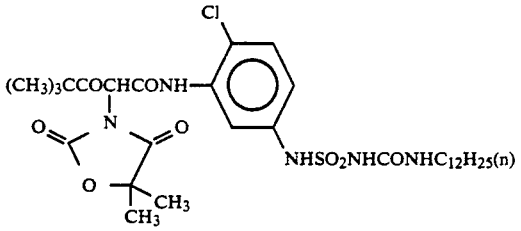
(9)
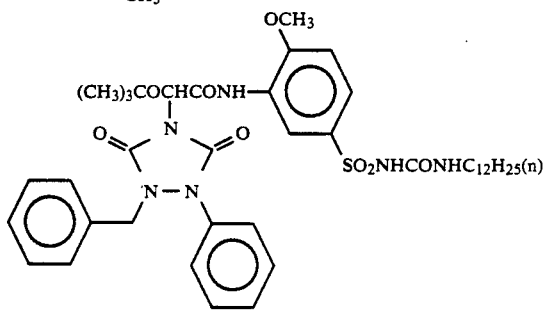
(10)
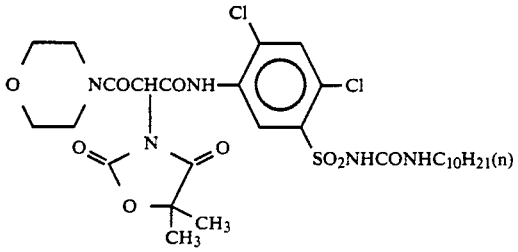
(11)
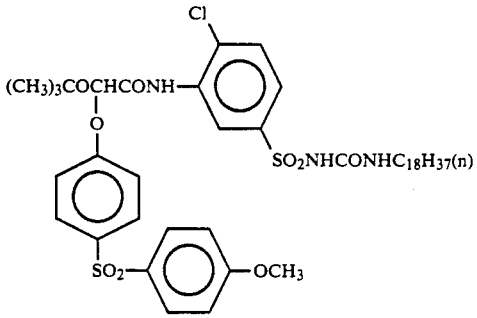
(12)
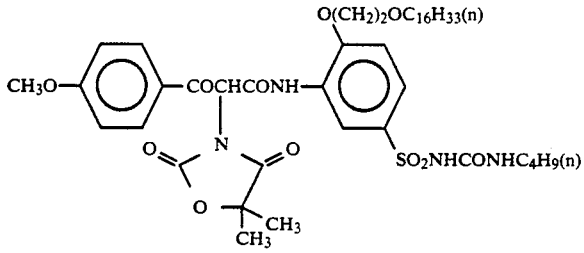
(13)
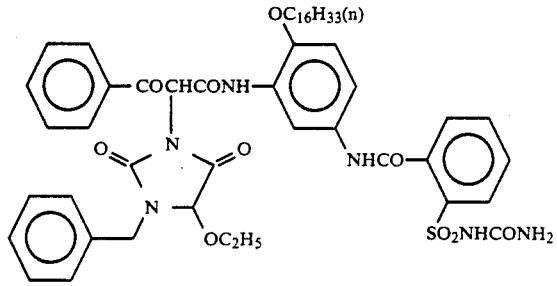

TABLE A-continued
(14)
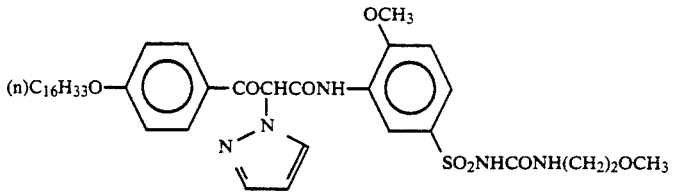
(15)
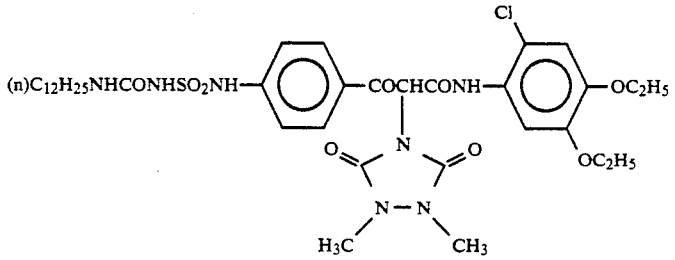
(16)
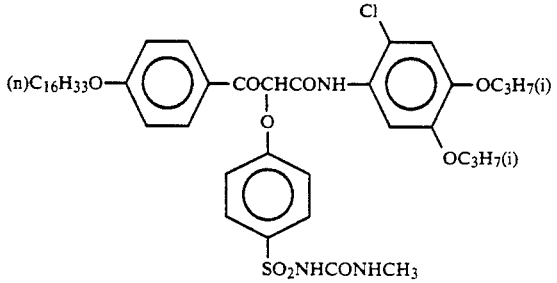
(17)
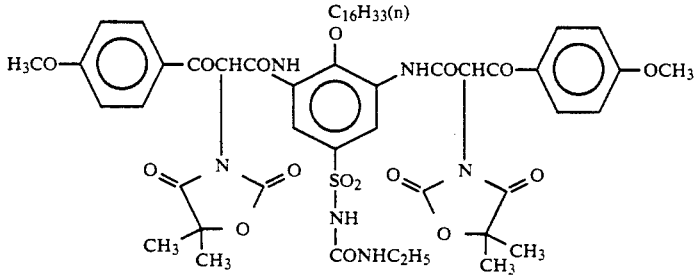
(18)
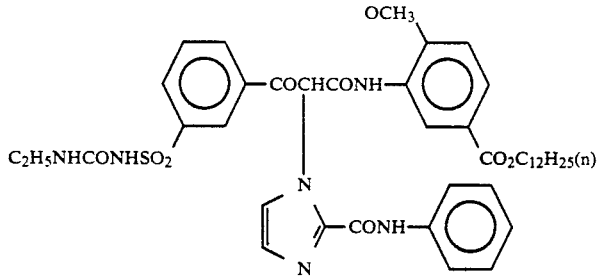
(19)
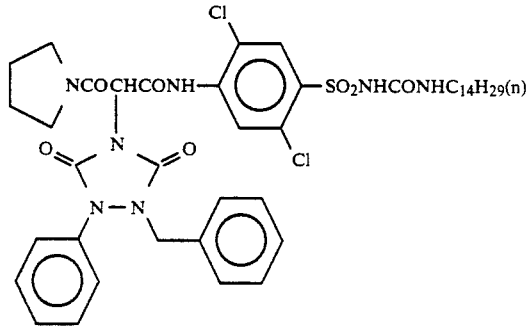

TABLE A-continued
(20)
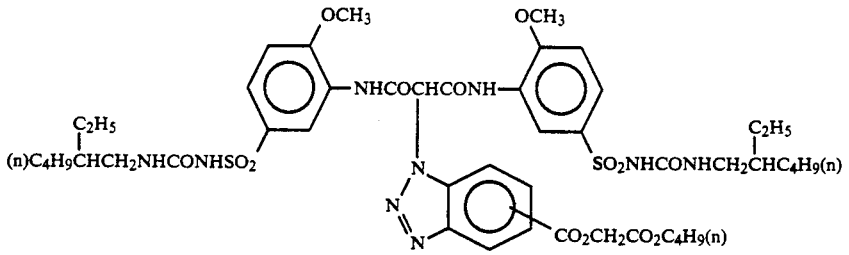
(21)
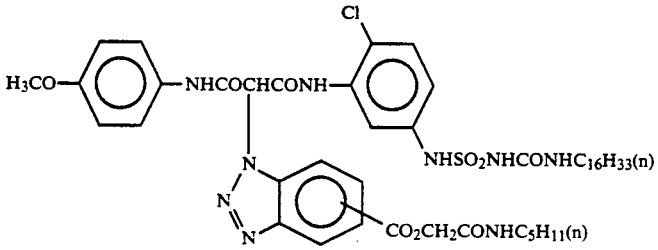
(22)
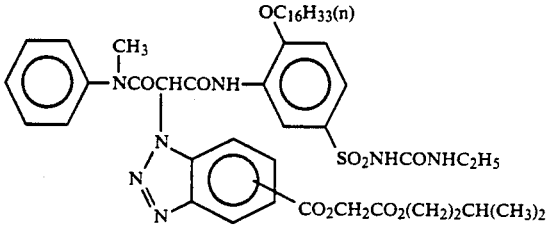
(23)
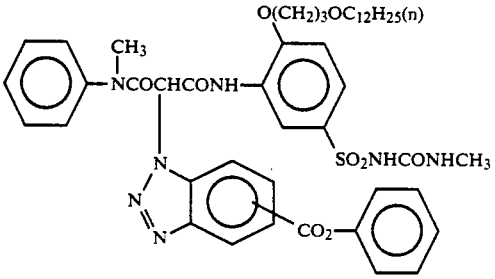
(24)
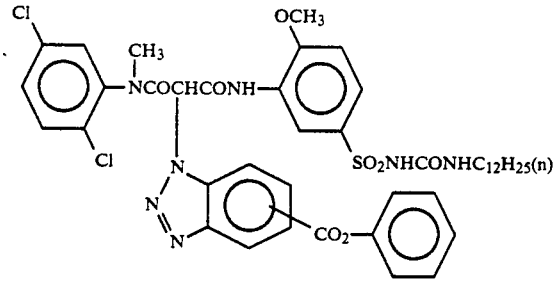
(25)
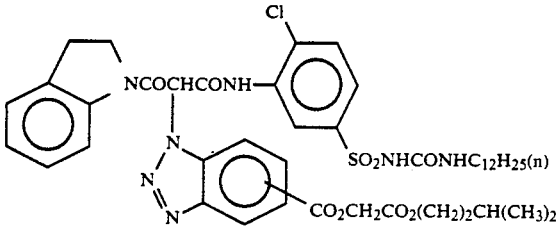

TABLE A-continued
(26)
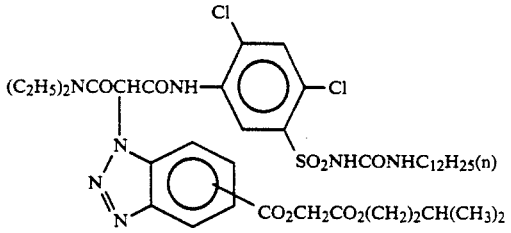
(27)
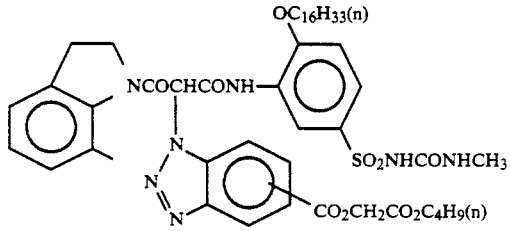
(28)
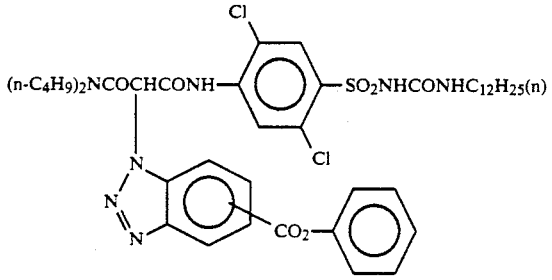
(29)
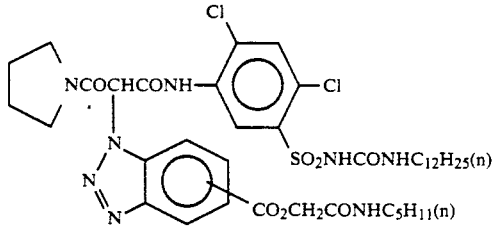
(30)
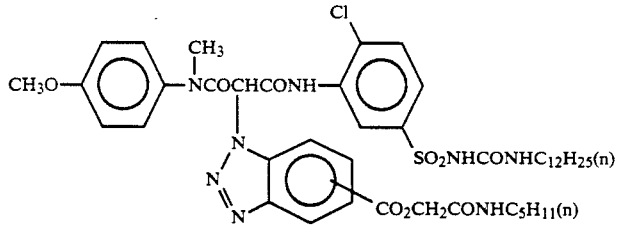
(31)
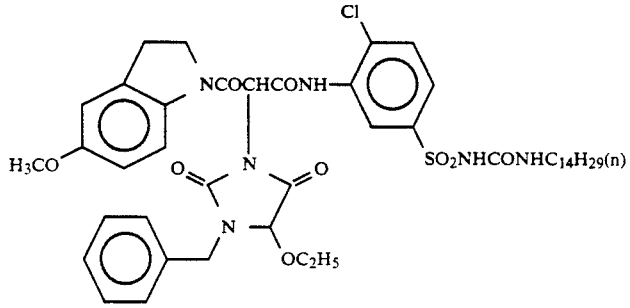

TABLE A-continued
(32)
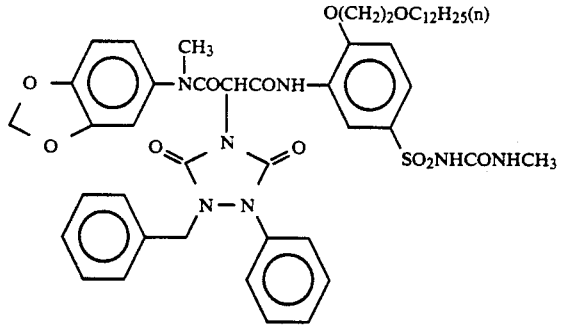
(33)
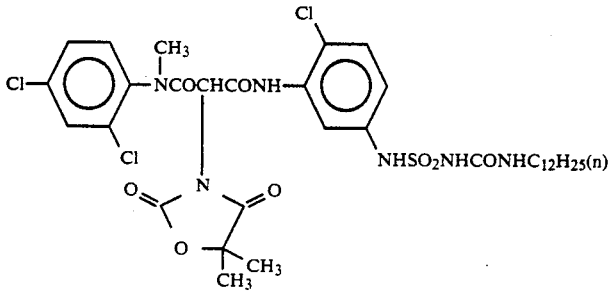
(34)
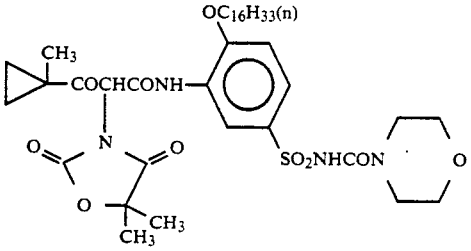
(35)
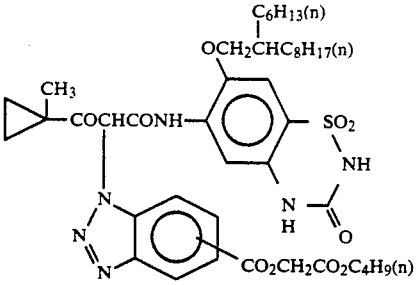
(36)
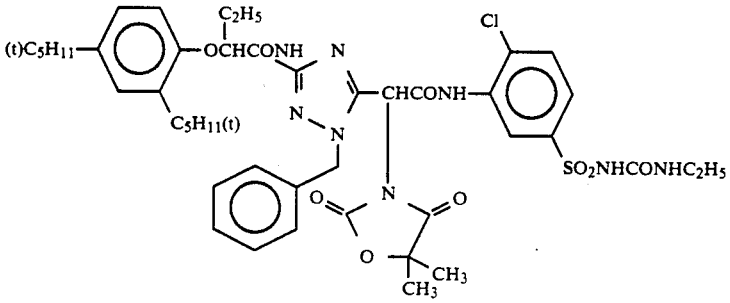

TABLE A-continued
(37)
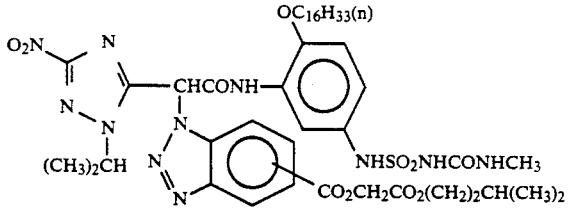
(38)
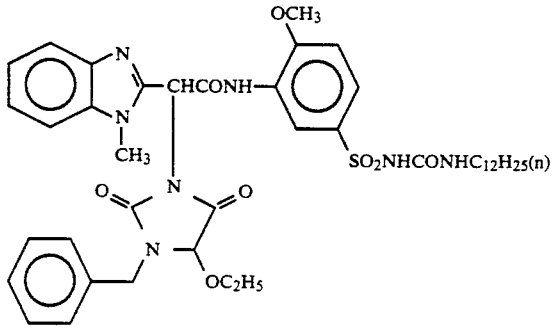
(39)
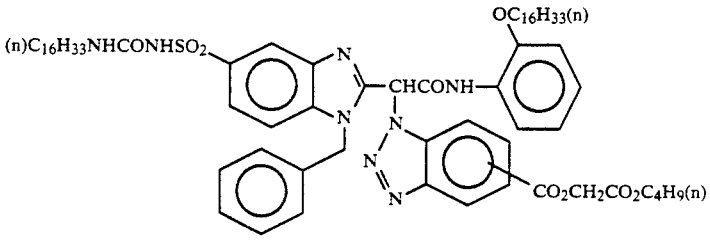
(40)
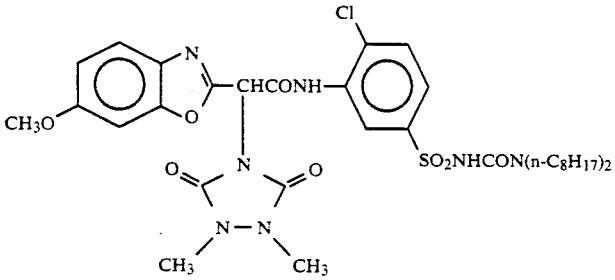
(41)
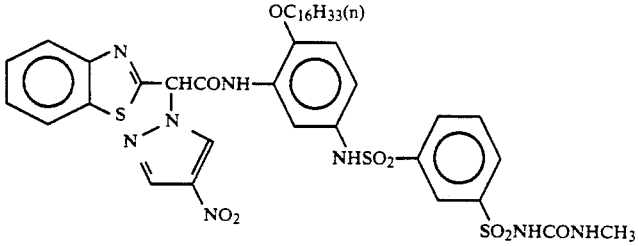
(42)
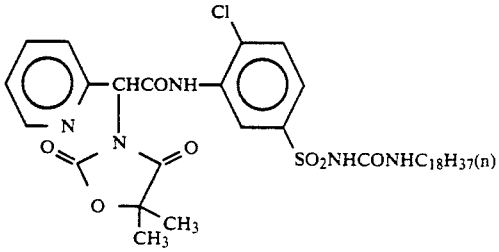

TABLE A-continued
(43)
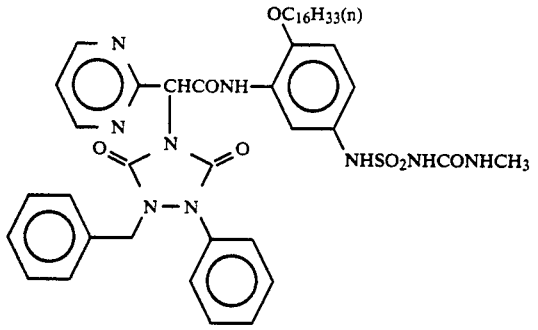
(44)
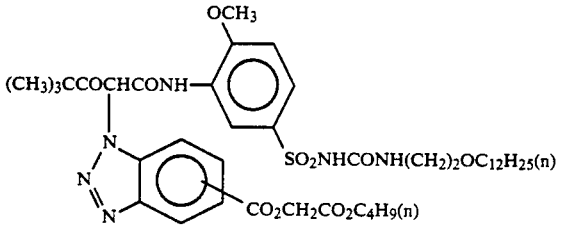
(45)
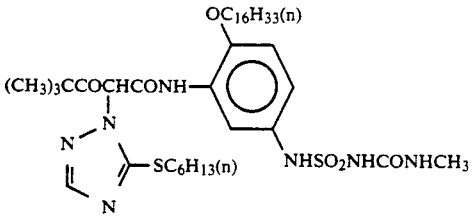
(46)
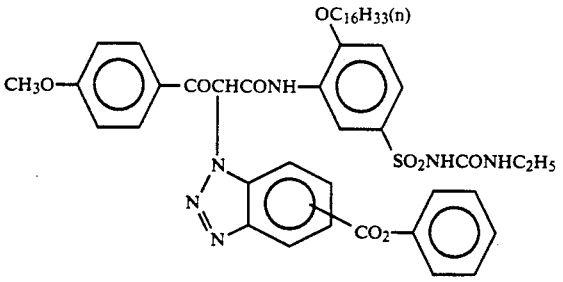
(47)
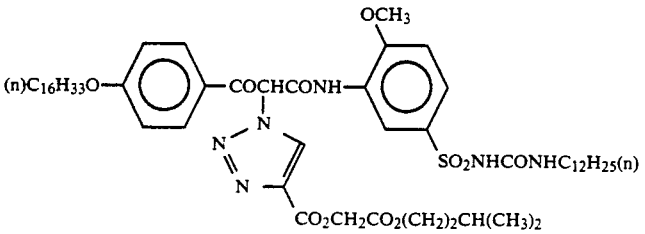

TABLE A-continued
(48)
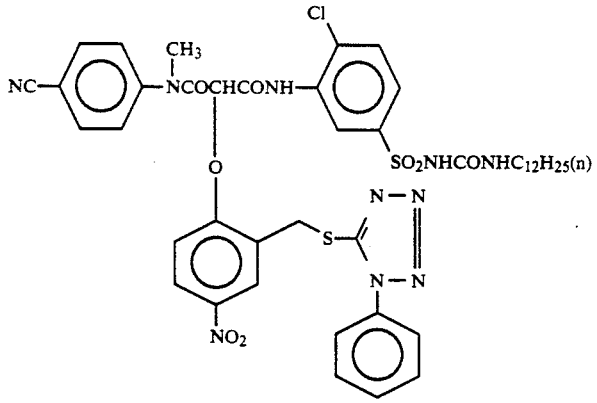
(49)
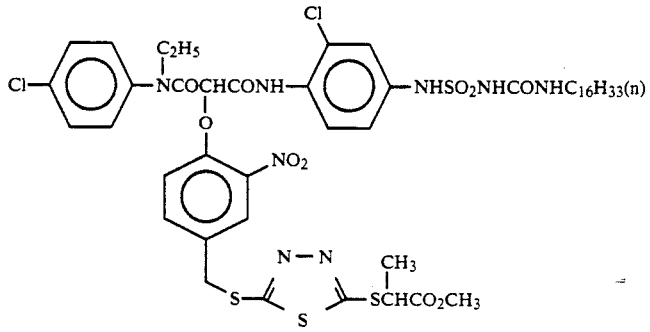
(50)
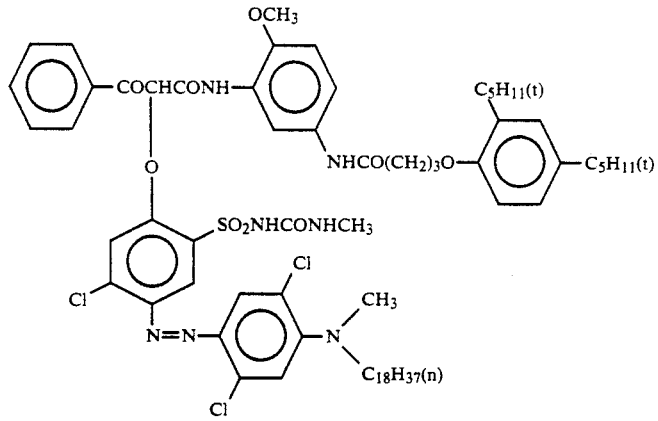
(51)
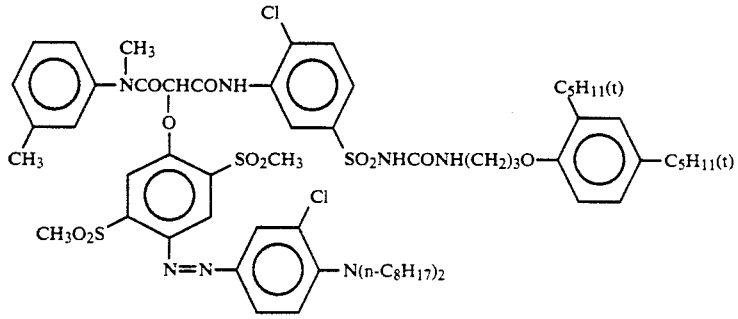

TABLE A-continued
(52)
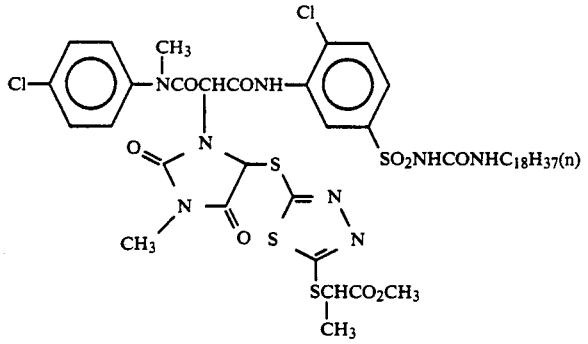
(53)
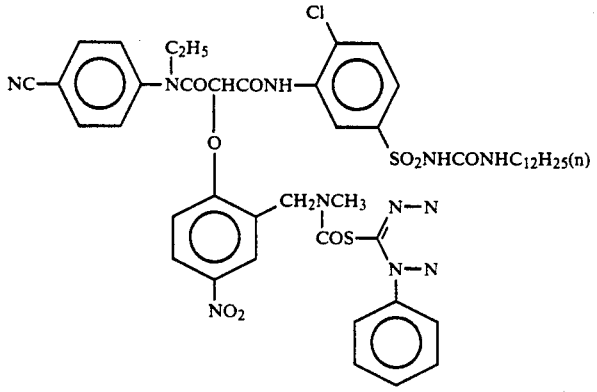
(54)
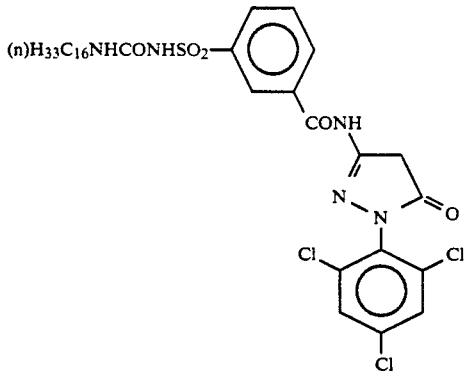
(55)
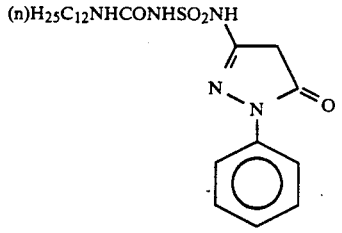

TABLE A-continued
(56)
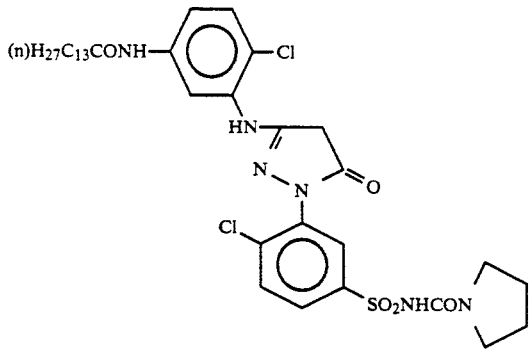
(57)
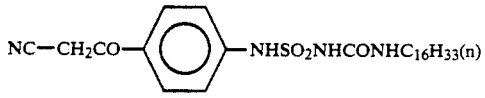
(58)
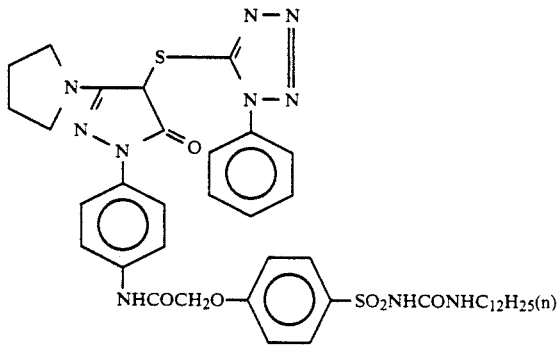
(59)
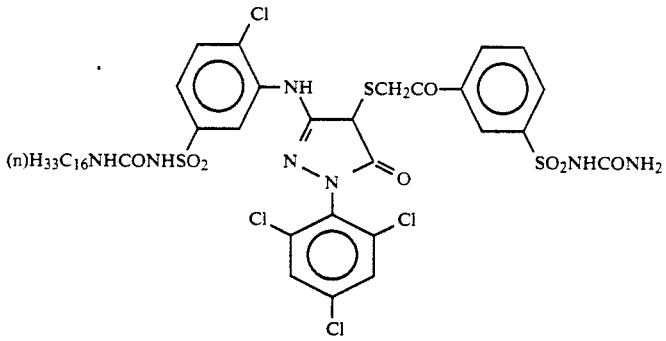
(60)
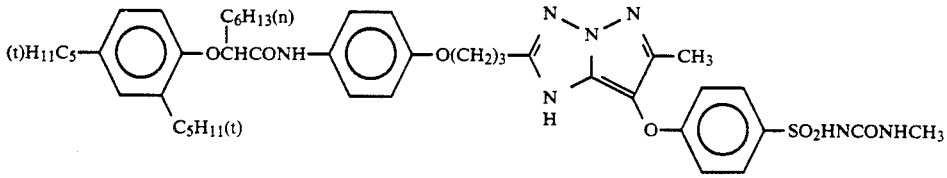
(61)
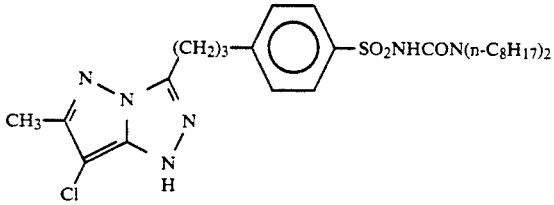

TABLE A-continued
(62)
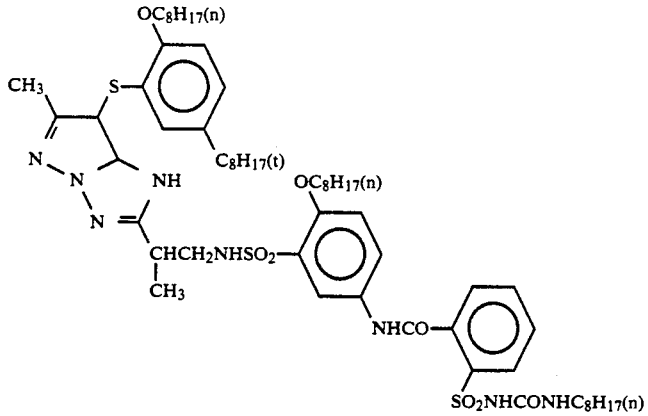
(63)
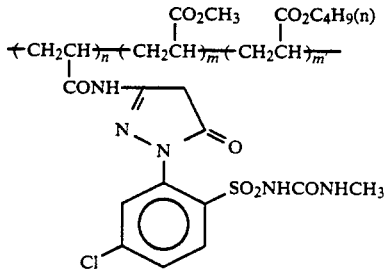
n/(m + m') = 1
m/m' = 1
(weight ratio)
molecular weight: about 40,000
(64)
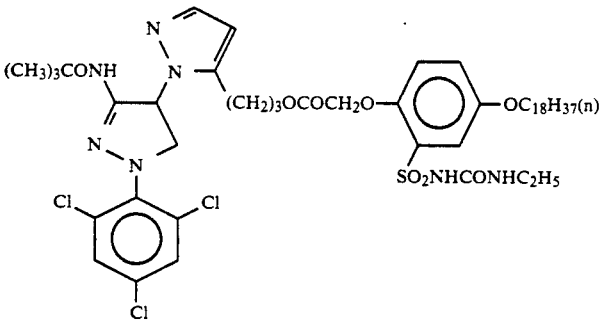
(65)
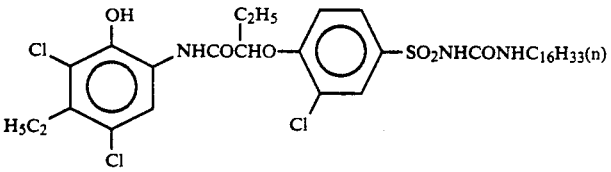
(66)
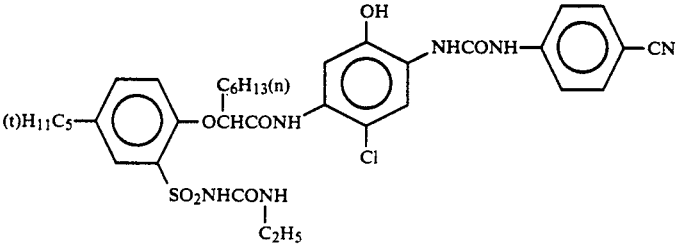

TABLE A-continued
(67)
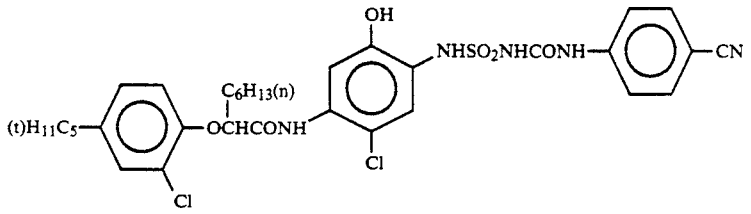
(68)
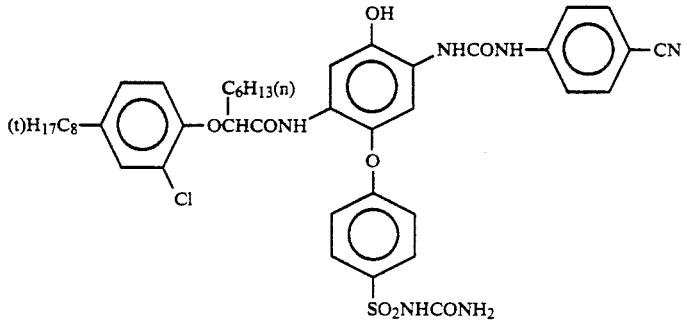
(69)
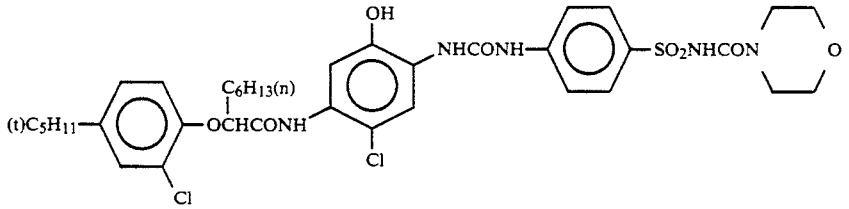
(70)
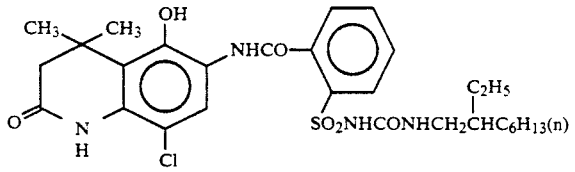
(71)
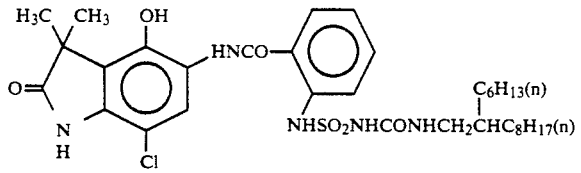
(72)
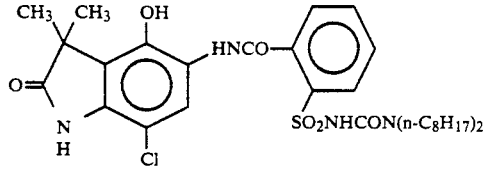
(73)
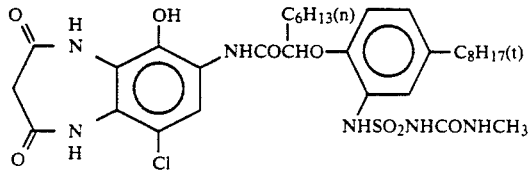

TABLE A-continued
(74)
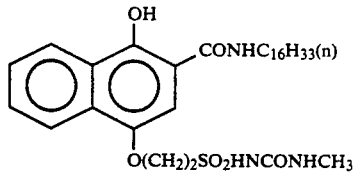
(75)
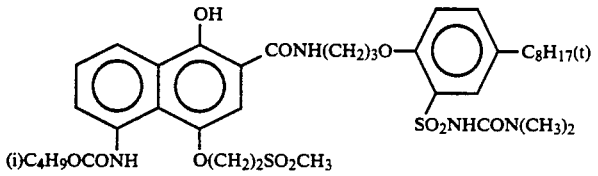
(76)
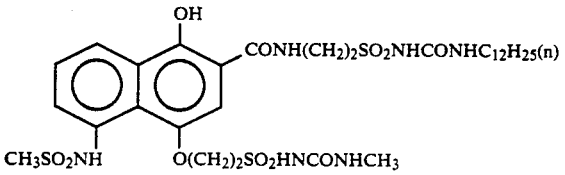
(77)
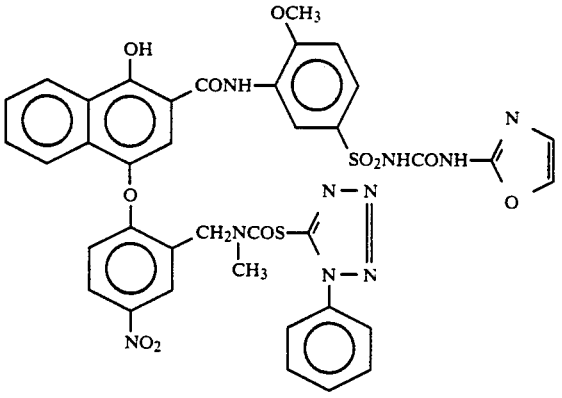
(78)
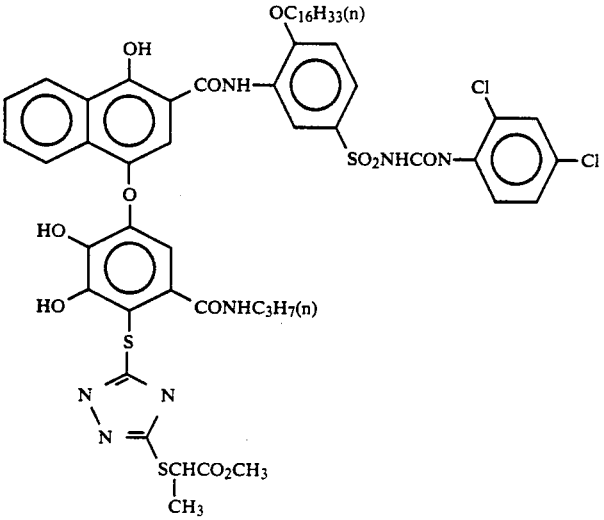

TABLE A-continued
(79)
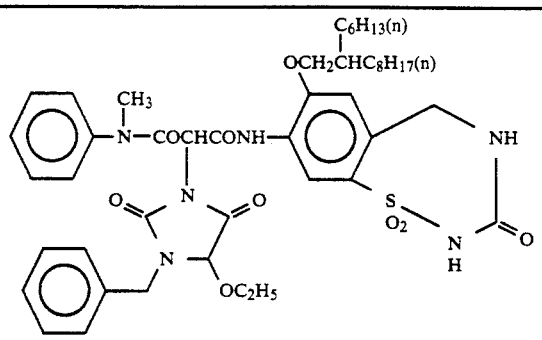
(80)
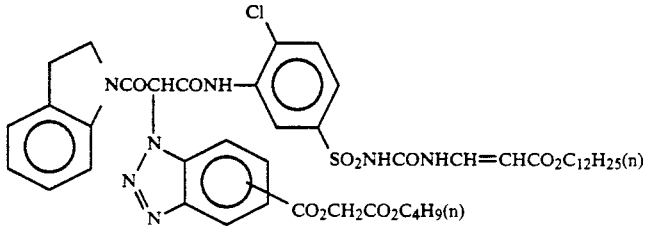
(81)
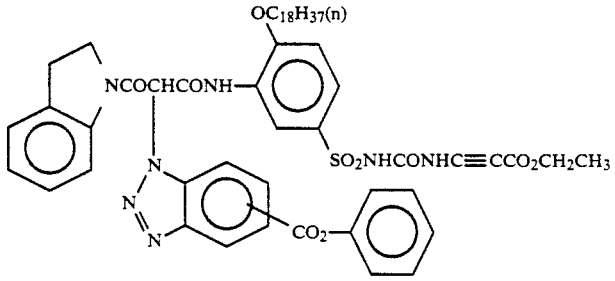
(82)
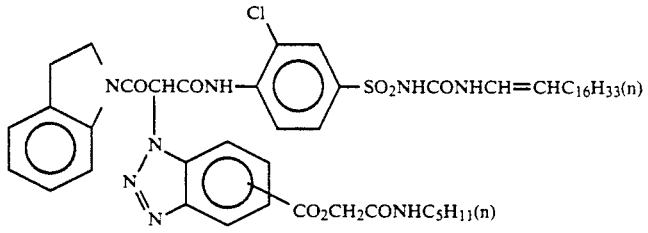
(83)
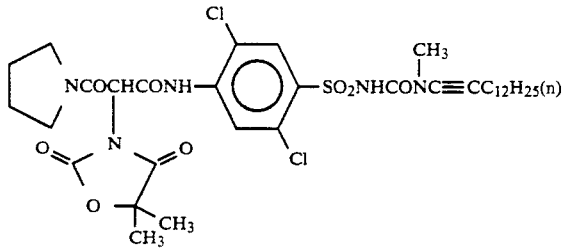
TABLE B
| comparative coupler |
|---|
| C-1 (coupler disclosed in British Patent No. 909,318) |
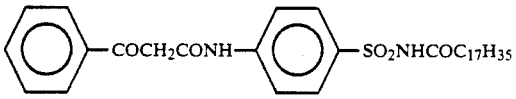

TABLE B-continued
comparative coupler
C-2 (coupler disclosed in British Patent No. 909,318)
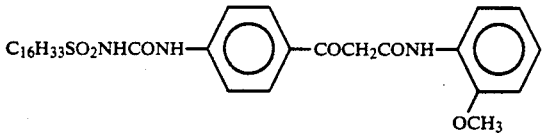
C-3 (coupler disclosed in JP-A-61-121054)
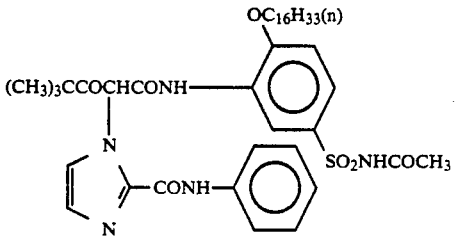
C-4 (coupler disclosed in JP-A-58-42045)
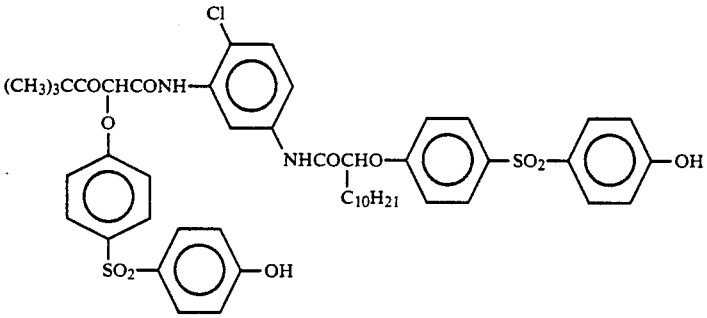
C-5 (coupler disclosed in JP-B-62-61251)
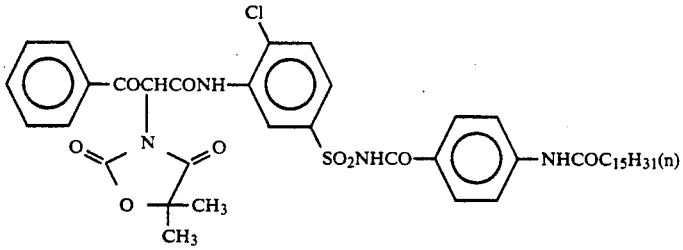
C-6 (coupler disclosed in JP-A-2-28645)
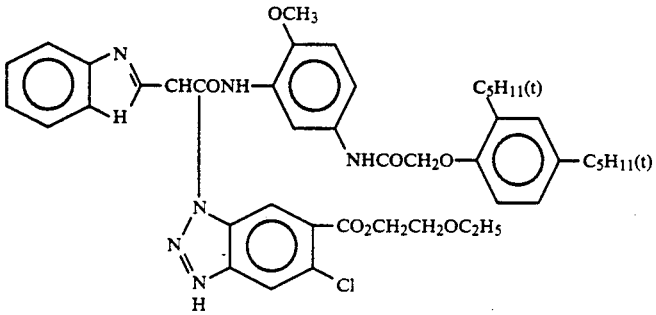

TABLE B-continued
comparative coupler
C-7 (coupler disclosed in JP-A-2-2552)
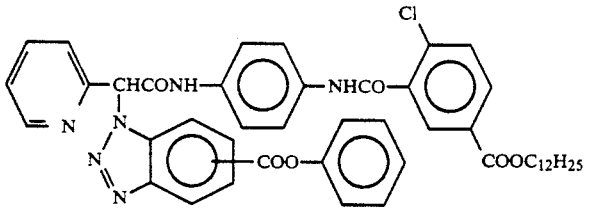
C-8 (coupler disclosed in JP-A-63-261262)
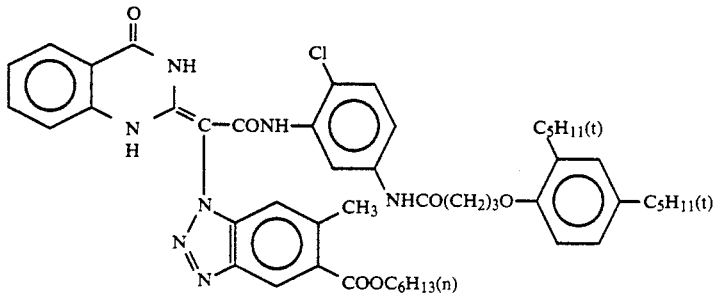
C-9 (coupler similar to that disclosed in JP-A-52-69624)
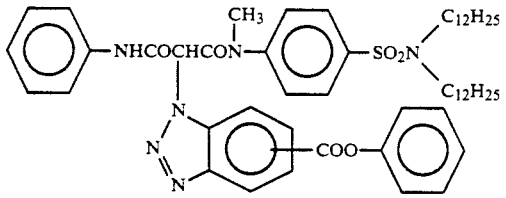
TABLE C
EX-1
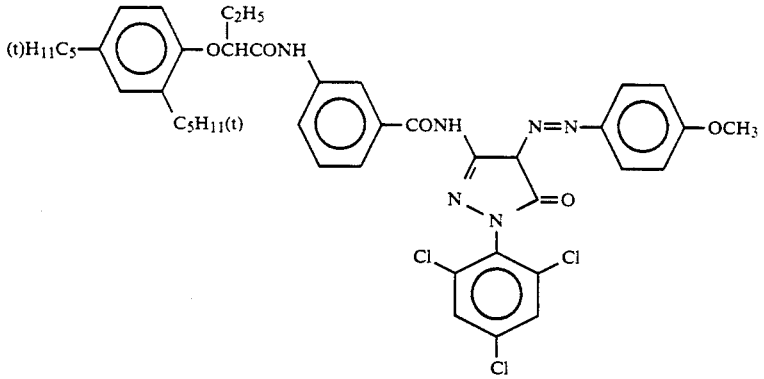
EX-2
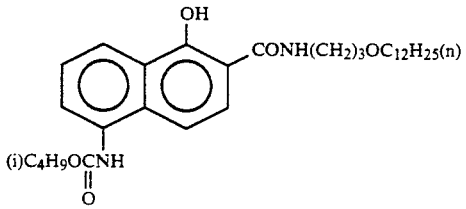

TABLE C-continued
EX-3
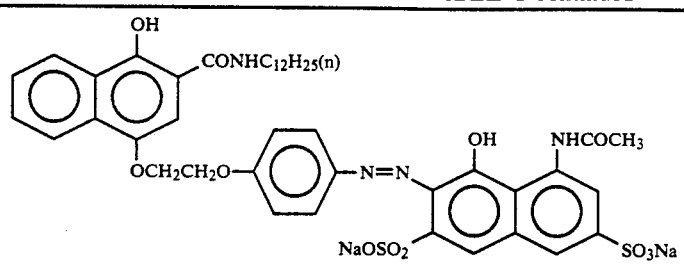
EX-4
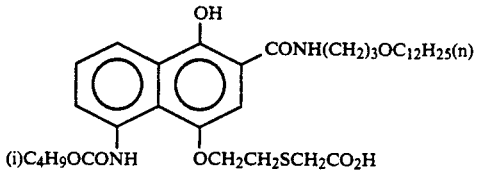
EX-5
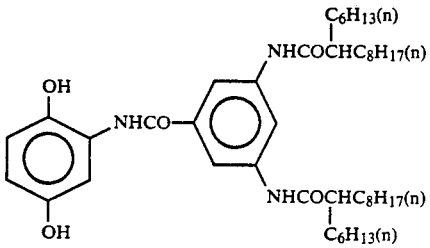
EX-6
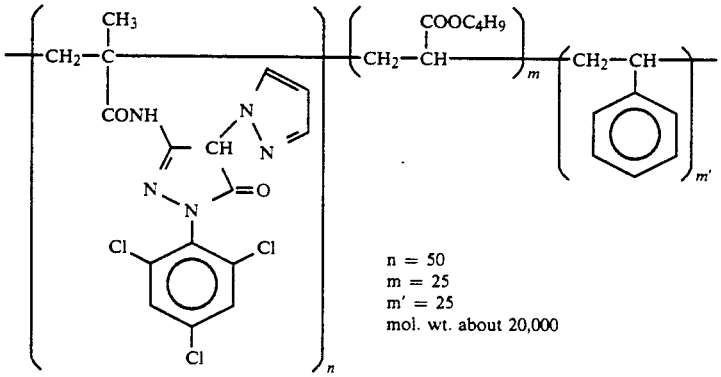
EX-7
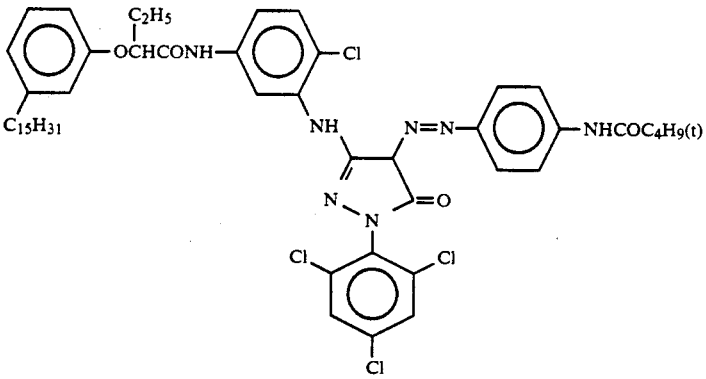
EX-8
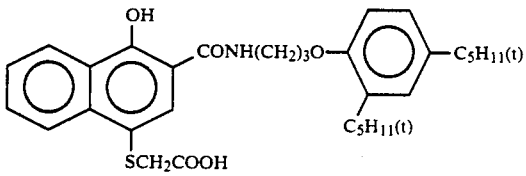

TABLE C-continued
EX-9
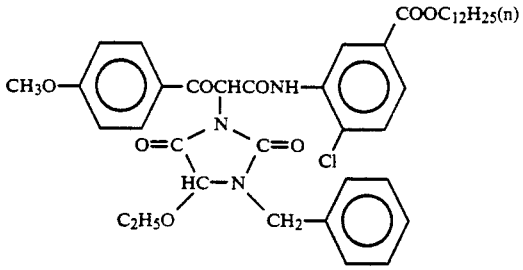
EX-10
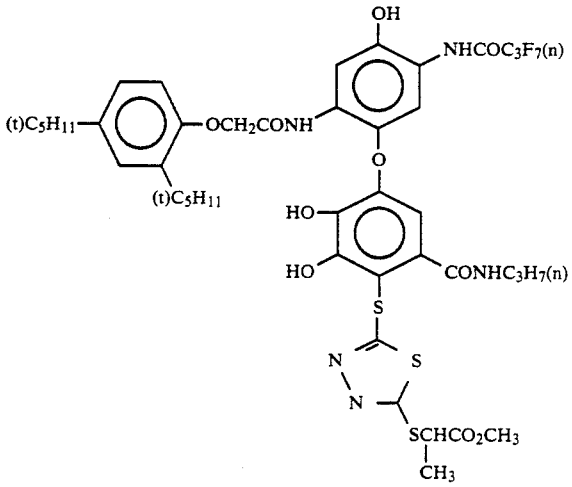
EX-11
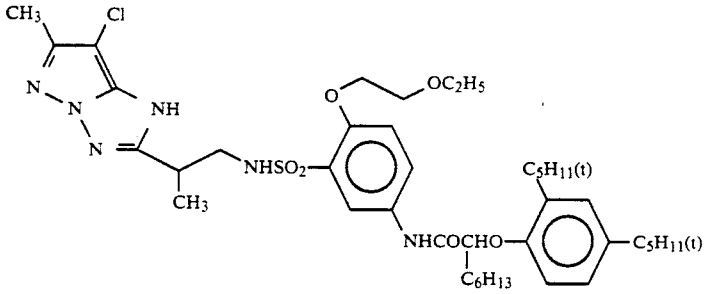
EX-12
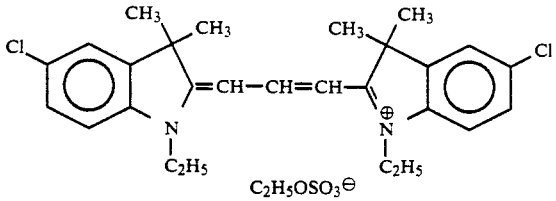
EX-13
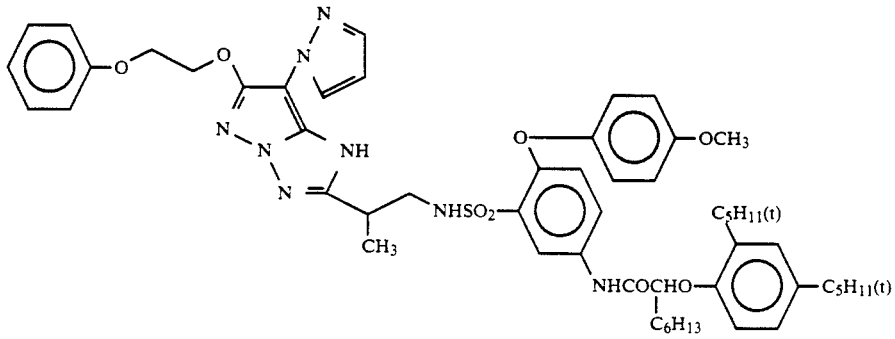

TABLE C-continued
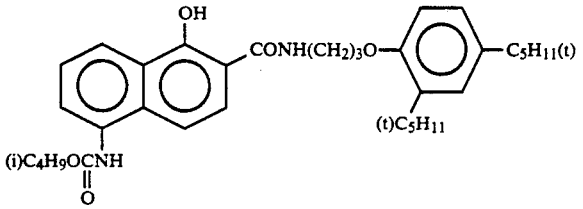
EX-14
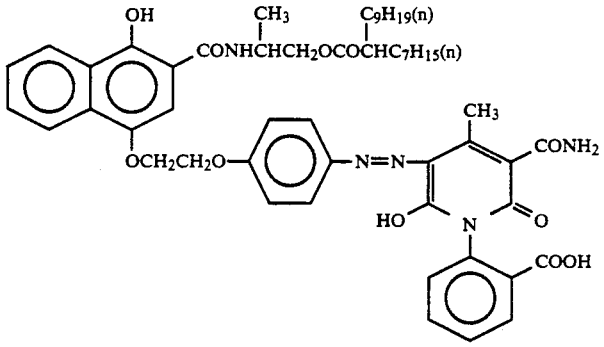
EX-15
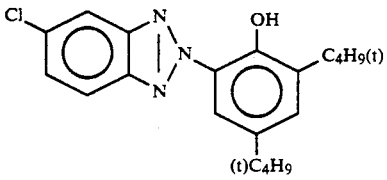
U-1
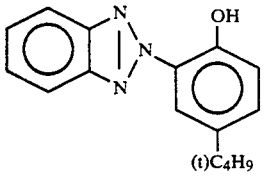
U-2
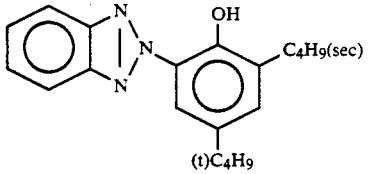
U-3
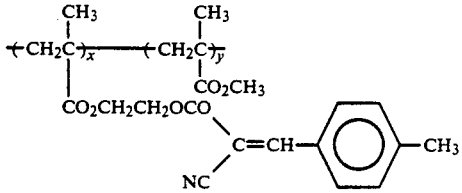
x:y = 70:30 (wt %)
U-4
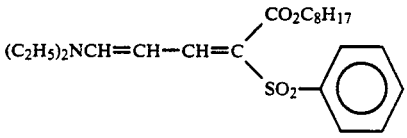
U-5
tricresyl phosphate HBS-1
di-n-butylphthalate HBS-2

TABLE C-continued
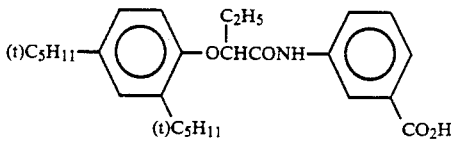
HBS-3
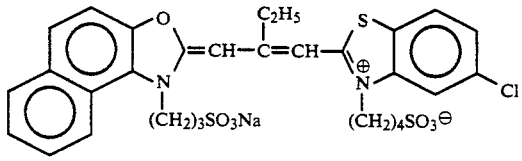
sensitizing dye I
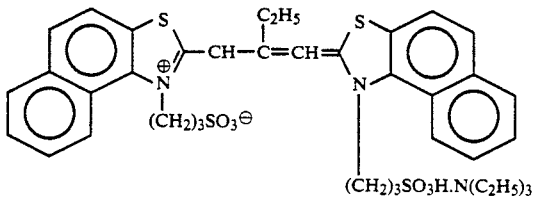
sensitizing dye II
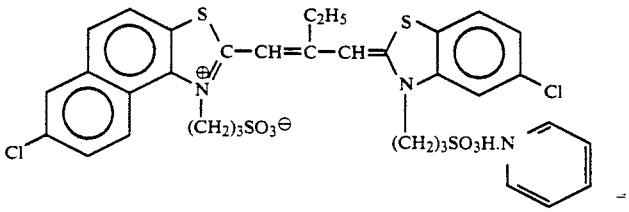
sensitizing dye III
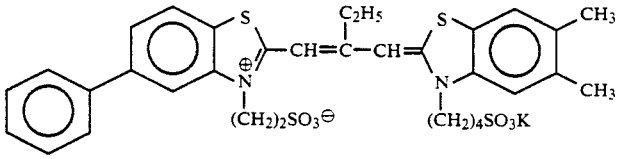
sensitizing dye IV
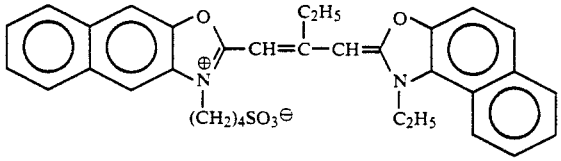
sensitizing dye V
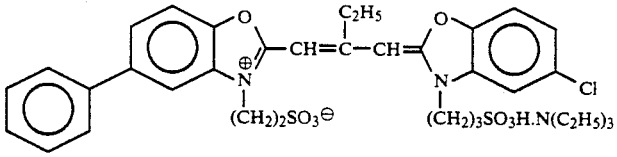
sensitizing dye VI
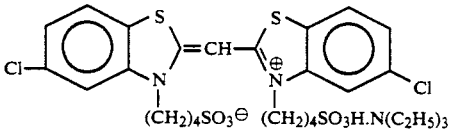
sensitizing dye VII
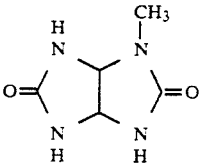
S-1

TABLE C-continued

| | |
|---|---|
| $CH_2{=}CH{-}SO_2{-}CH_2{-}CONH{-}CH_2$<br>$CH_2{=}CH{-}SO_2{-}CH_2{-}CONH{-}CH_2$ | H-1 |
| $\left(CH_2{-}\underset{COOH}{\underset{\mid}{C}}\right)_x\left(CH_2{-}\underset{COOH_3}{\underset{\mid}{C}}\right)_y$ x/y = 10/90 (wt %) | B-1 |
| $\left(CH_2{-}\underset{COOH}{\underset{\mid}{C}}\right)_x\left(CH_2{-}\underset{COOCH_3}{\underset{\mid}{C}}\right)_y$ x/y = 40/60 (wt %) | B-2 |
| $(CH_3)_3SiO\left(\underset{CH_2-CH-C_6H_5}{\underset{\mid}{Si}}{-}O\right)_{29}\left(\underset{CH_3}{\underset{\mid}{Si}}{-}O\right)_{46}Si(CH_3)_3$ | B-3 |
| $\left(CH_2{-}CH\right)_n$ 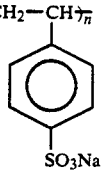 n ≈ 5,000 | B-4 |
| $\left(CH_2{-}\underset{N}{CH}\right)_x\left(CH_2{-}\underset{OH}{CH}\right)_y$ x/y = 70/30 (wt %) 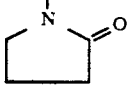 | B-5 |
| $C_8F_{17}SO_2NHCH_2CH_2CH_2OCH_2CH_2\overset{\oplus}{N}(CH_3)_3$ 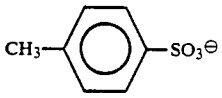 | W-1 |
| $C_8H_{17}$ 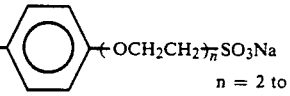 $\left(OCH_2CH_2\right)_n SO_3Na$ n = 2 to 4 | W-2 |
| 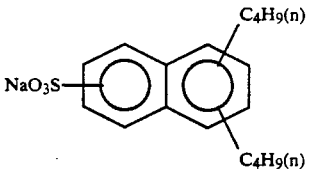 | W-3 |
| 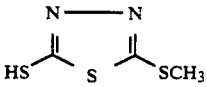 | F-1 |
| 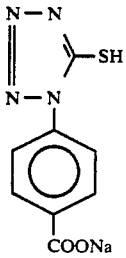 | F-2 |

TABLE C-continued
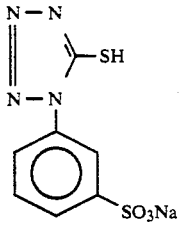
F-3
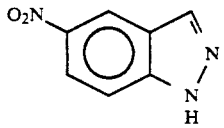
F-4
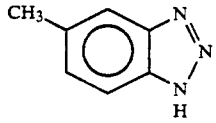
F-5
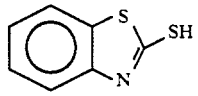
F-6
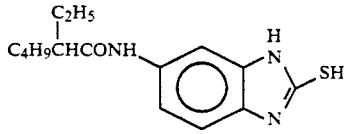
F-7
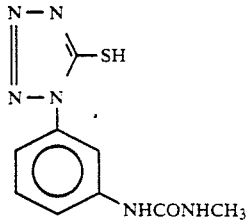
F-8
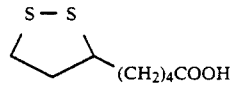
F-9
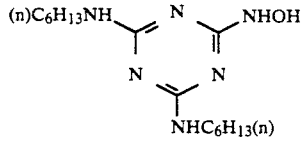
F-10
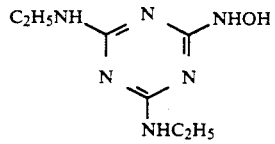
F-11
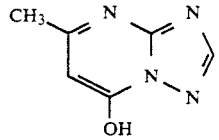
F-12

TABLE C-continued
F-13
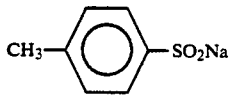
TABLE D
(ExY) yellow coupler
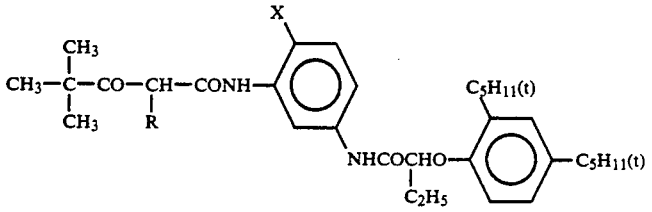
mixture (molar ratio, 1:1) of
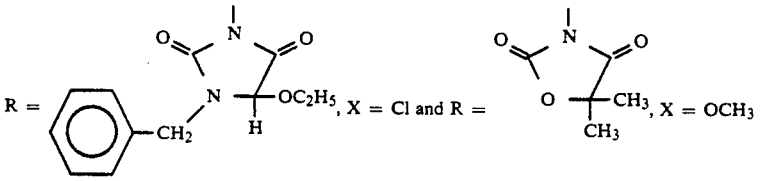
(ExC) cyan coupler
mixture (molar ratio, 1:1:1) of
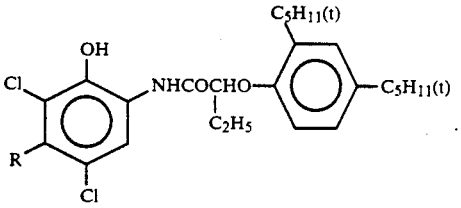
R = $CH_3$,
a compound represented by the above formula wherein
R = $C_2H_5$, and
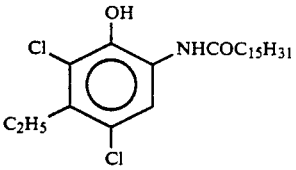
(Cpd-8) dye stabilizer mixture (molar ratio, 1:1) of
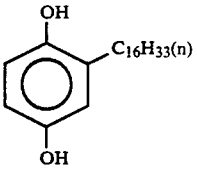
and
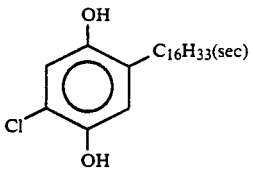
(Cpd-10) antiseptic agent
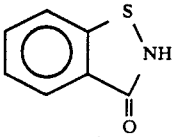
(25.0 mg/m$^2$)
(Cpd-11) antiseptic agent
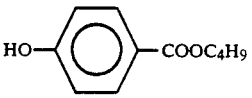
(50.0 mg/m$^2$)
(Solv-6) solvent mixture (weight ratio, 9:1) of TABLE D-continued

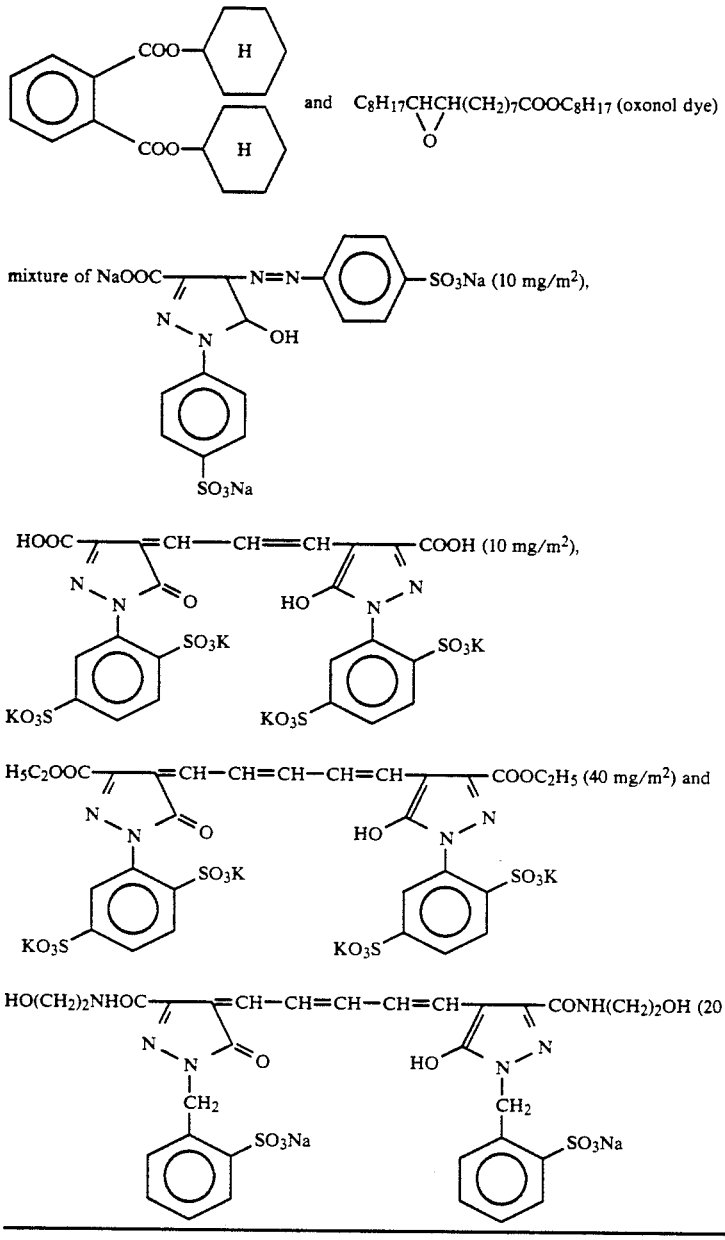

What is claimed is:

1. A silver halide color photographic light-sensitive material, comprising a support and at least one hydrophilic colloid layer formed on the support, said hydrophilic colloid layer containing a coupling compound represented by formula (I) below:

$$A—(SO_2NHCONR^1R^2)n \quad (I)$$

wherein A represents a coupler moiety, each of $R^1$ and $R^2$ independently represents a hydrogen atom, an alkyl group, an alkenyl group, an alkynyl group, an aryl group, or a heterocyclic group, and n represents an integer of not less than 1, if n is an integer of not less than 2, respective $R^1$'s and $R^2$'s can be the same or different, and A and $R^1$, A and $R^2$, or $R^1$ and $R^2$ may combine to form a ring;

wherein said coupler moiety A is represented by one of formula (Cp-1) to (Cp-7) below:

$$R^{11}—\underset{\underset{X^{11}}{|}}{CH}—\overset{\overset{O}{||}}{C}—R^{12} \quad (Cp\text{-}1)$$

wherein $R^{11}$ represents $R^{31}CO$—, $R^{32}$, or $R^{33}R^{34}NCO$—, $R^{12}$ represents $R^{33}$, $R^{33}O$—, or $R^{33}R^{34}N$—, $R^{31}$ represents an alkyl group, an alkenyl group, an alkynyl group, an aryl group, or a heterocyclic group, $R^{32}$ represents an aryl group or a heterocyclic group, and each of $R^{33}$ and $R^{34}$ independently represents a hydrogen atom, an alkyl group, an alkenyl group, an alkynyl group, an aryl group, or a heterocyclic group, and $X^{11}$ represents a coupling split-off group;

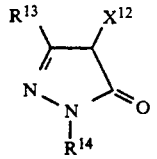

(Cp-2)

wherein $R^{13}$ represents $R^{31}$, $R^{31}CONR^{33}$—, $R^{31}R^{33}N$—, $R^{31}SO_2NR^{33}$—, $R^{31}S$—, $R^{33}O$—, $R^{33}R^{35}NCONR^{34}$—, $R^{31}O_2C$—, $R^{33}R^{34}NCO$—, or N≡C—, $R^{35}$ represents a hydrogen atom, an alkyl group, an alkenyl group, an alkynyl group, an aryl group, or a heterocyclic group, $R^{14}$ has the same meaning as $R^{31}$, and $X^{12}$ represents a coupling split-off group;

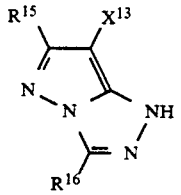

(Cp-3)

wherein each of $R^{15}$ and $R^{16}$ independently represents $R^{33}$, $R^{31}S$—, $R^{33}O$, $R^{31}CONR^{33}$—, $R^{31}R^{33}N$—, $R^{31}OCONR^{33}$—, $R^{33}R^{34}NCONR^{35}$—, or $R^{31}SO_2NR^{33}$—, and $X^{13}$ represents a coupling split-off group;

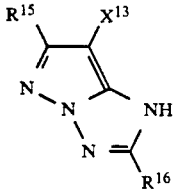

(Cp-4)

wherein each of $R^{15}$ and $R^{16}$ independently represents $R^{33}$, $R^{31}S$—, $R^{33}O$, $R^{31}CONR^{33}$—, $R^{31}R^{33}N$—, $R^{31}OCONR^{33}$—, $R^{33}R^{34}NCONR^{35}$—, or $R^{31}SO_2NR^{33}$—, and $X^{13}$ represents a coupling split-off group;

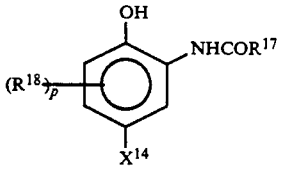

(Cp-5)

wherein $R^{17}$ has the same meaning as $R^{31}$, $R^{18}$ represents $R^{31}$, $R^{31}CONR^{33}$—, $R^{31}OCONR^{33}$—, $R^{31}SO_2NR^{33}$—, $R^{33}R^{34}NCONR^{35}$—, $R^{33}R^{34}NSO_2NR^{35}$—, $R^{31}S$—, $R^{33}O$—, a halogen atom, or $R^{31}R^{33}N$—, $X^{14}$ represents a coupling split-off group, p represents 0, 1, 2, or 3, and if p represents a plural number, the respective $R^{18}$'s may be the same or different or may combine as divalent groups to form a cyclic structure;

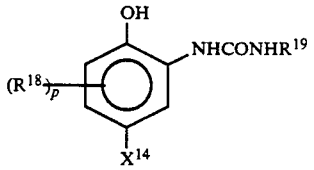

(Cp-6)

wherein $R^{18}$ represents $R^{31}$, $R^{31}CONR^{33}$—, $R^{31}OCONR^{33}$—, $R^{31}SO_2NR^{33}$—, $R^{33}R^{34}NCONR^{35}$—, $R^{33}R^{34}NSO_2NR^{35}$—, $R^{31}S$—, $R^{33}O$—, a halogen atom, or $R^{31}R^{33}N$—, $X^{14}$ represents a coupling split-off group, and p represents 0, 1, 2, or 3, and if p represents a plural number, the respective $R^{18}$'s may be the same or different or may combine as divalent groups to form a cyclic structure, and $R^{19}$ has the same meaning as $R^{31}$; and

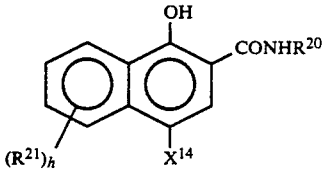

(Cp-7)

wherein $R^{20}$ has the same meaning as $R^{31}$, $R^{21}$ represents $R^{31}$, $R^{31}CONH$—, $R^{31}SO_2NH$—, $R^{31}OCONH$—, $R^{33}R^{34}NCONR^{35}$—, $R^{33}R^{34}NSO_2NR^{35}$—, $R^{31}S$—, $R^{33}O$—, a halogen atom, or $R^{31}R^{33}N$—, h represents an integer from 0 to 4, if a plurality of $R^{31}$'s are present, they may be the same or different, and $X^{14}$ represents a coupling split-off group;

wherein in formulas (Cp-2) to (Cp-7), $R^{31}$, $R^{32}$, $R^{33}$ and $R^{34}$ have the same meaning as in formula (Cp-1), and wherein in formulas (Cp-3) to (Cp-7), $R^{35}$ has the same meaning as in formula (Cp-2).

2. A silver halide color photographic light-sensitive material, according to claim 1, wherein $R^{12}$ represents $R^{33}R^{34}N$—, and $R^{33}$ and $R^{34}$ independently represents a hydrogen atom, an alkyl group, an aryl group, or a heterocyclic group in formula (Cp-1).

3. A silver halide color photographic light-sensitive material, according to claim 1, wherein $X^{11}$ represents $R^{32}O$—, an imido group which combines with a coupling position by a nitrogen atom, a nitrogen-containing heterocyclic group, or $R^{31}S$— in formula (Cp-1).

4. A silver halide color photographic light-sensitive material, according to claim 1, wherein $X^{12}$ represents $R^{31}S$—, an unsaturated nitrogen-containing heterocyclic group or $R^{32}O$— in formula (Cp-2).

5. A silver halide color photographic light-sensitive material, according to claim 1, wherein $X^{13}$ represents a halogen atom, $R^{31}S$—, $R^{31}O$—, $R^{31}CO_2$—, or an unsaturated nitrogen-containing heterocyclic group which combines with a coupling position by a nitrogen atom in formula (Cp-3).

6. A silver halide color photographic light-sensitive material, according to claim 1, wherein $X^{13}$ represents a halogen atom, $R^{31}S$—, $R^{31}O$—, $R^{31}CO_2$—, or an unsaturated nitrogen-containing heterocyclic group which combines with a coupling position by a nitrogen atom in formula (Cp-4).

7. A silver halide color photographic light-sensitive material, according to claim 1, wherein $X^{14}$ represents chlorine atom, $R^{31}O$—, or $R^{31}S$— in formula (Cp-5).

8. A silver halide color photographic light-sensitive material, according to claim 1, wherein $X^{14}$ represents a halogen atom, $R^{31}O$—, or $R^{31}S$— in formula (Cp-6).

9. A silver halide color photographic light-sensitive material, according to claim 1, wherein $R^{21}$ represents $R^{31}OCONH$—, $R^{31}CONH$—, or $R^{31}SO_2NH$—, and h represents 1 in formula (Cp-7).

10. A silver halide color photographic light-sensitive material, according to claim 1, wherein the substitution position of $R^{21}$ is the 5 position of the naphthol ring in formula (Cp-7).

11. A silver halide color photographic light-sensitive material, according to claim 1, wherein $X^{14}$ represents a halogen atom, $R^{31}O$— or $R^{31}S$— in formula (Cp-7).

12. A silver halide color photographic light-sensitive material, according to claim 1, wherein n represents 1 in formula (I).

* * * * *